US008281549B2

(12) United States Patent
Du

(10) Patent No.: US 8,281,549 B2
(45) Date of Patent: Oct. 9, 2012

(54) FLOOR PANEL, FLOORING SYSTEM AND METHOD FOR LAYING FLOORING SYSTEM

(75) Inventor: Yongsheng Du, Shenzhen (CN)

(73) Assignee: Yekalon Industry, Inc., Shenzen (CN)

( * ) Notice: Subject to any disclaimer, the term of this patent is extended or adjusted under 35 U.S.C. 154(b) by 360 days.

(21) Appl. No.: 12/297,028

(22) PCT Filed: Apr. 14, 2006

(86) PCT No.: PCT/CN2006/000684

§ 371 (c)(1),
(2), (4) Date: Sep. 1, 2009

(87) PCT Pub. No.: WO2007/118352

PCT Pub. Date: Oct. 25, 2007

(65) Prior Publication Data

US 2010/0018147 A1 Jan. 28, 2010

(51) Int. Cl.
*E04B 1/00* (2006.01)

(52) U.S. Cl. ..... 52/747.1; 52/591.1

(58) Field of Classification Search ..... 52/589.1, 52/591.1, 592.1, 747.1; 403/339, 340
See application file for complete search history.

(56) References Cited

U.S. PATENT DOCUMENTS

| | | | | |
|---|---|---|---|---|
| 6,209,278 | B1 * | 4/2001 | Tychsen | 52/592.4 |
| 6,521,314 | B2 * | 2/2003 | Tychsen | 428/60 |
| 6,647,689 | B2 * | 11/2003 | Pletzer et al. | 52/592.1 |
| 7,093,399 | B2 * | 8/2006 | Thiers et al. | 52/592.1 |
| 7,121,058 | B2 * | 10/2006 | Palsson et al. | 52/592.2 |
| 7,127,860 | B2 * | 10/2006 | Pervan et al. | 52/592.1 |
| 7,168,217 | B2 * | 1/2007 | Weber | 52/592.1 |
| 7,451,578 | B2 * | 11/2008 | Hannig | 52/586.1 |
| 7,603,826 | B1 * | 10/2009 | Moebus | 52/592.1 |
| 7,726,088 | B2 * | 6/2010 | Muehlebach | 52/582.1 |
| 7,845,140 | B2 * | 12/2010 | Pervan | 52/747.1 |
| 2003/0009973 | A1 | 1/2003 | Lee | |
| 2004/0123547 | A1 | 7/2004 | Grafenauer | |
| 2009/0193741 | A1 * | 8/2009 | Cappelle | 52/309.1 |

FOREIGN PATENT DOCUMENTS

| | | | |
|---|---|---|---|
| CN | 2627120 | Y | 7/2004 |
| CN | 266706 | A | 12/2004 |
| CN | 1752375 | A | 3/2006 |
| DE | 10118256 | A1 | 11/2002 |

(Continued)

OTHER PUBLICATIONS

Office Action for corresponding Canadian Patent Application 2,644,265 dated Jan. 18, 2011.
EP 06722333, Supplementary European Search Report, Dated Apr. 14, 2010.

(Continued)

*Primary Examiner* — William Gilbert
*Assistant Examiner* — Gisele Ford
(74) *Attorney, Agent, or Firm* — Banner & Witcoff, Ltd.

(57) ABSTRACT

A floor panel comprises a protrusion end face having a protrusion and a recess end face having a recess. The profiles of the protrusion and the recess are allowed to be installed in the following manner: placing the protrusion nearby the recess of an already installed floor panel, and then applying a pressure to introduce the protrusion in the recess. A flooring system allows use of said method to install more than one floor panel. According to the solution of the present invention, the installation and pave of the floor panels is very simple and the installed floor panels do not easily separate.

32 Claims, 27 Drawing Sheets

FOREIGN PATENT DOCUMENTS

| | | | | |
|---|---|---|---|---|
| DE | 101118256 | A | | 11/2002 |
| EP | 1279778 | | | 1/2003 |
| EP | 1279778 | A2 | | 1/2003 |
| EP | 1350904 | | | 10/2003 |
| EP | 1350904 | A2 | | 10/2003 |
| WO | 00/47841 | A1 | | 8/2000 |
| WO | 01/75247 | A1 | | 10/2001 |
| WO | WO01/88306 | | * | 11/2001 |
| WO | 2004/003314 | A1 | | 1/2004 |
| WO | 2005068747 | | | 7/2005 |

OTHER PUBLICATIONS

Notification for the Office Action for Japanese patent application No. 2009-504548 mailed Sep. 6, 2011.

Office Action for European patent application No. 05722333.9-2303 mailed Nov. 18, 2011.

Office Action for Canadian patent application No. 2,644,265 mailed Jan. 27, 2012.

Notice of Preliminary Rejection for Korean patent application No. 10-2008-7027862 mailed Jan. 30, 2012.

* cited by examiner

FLOOR PANEL, FLOORING SYSTEM AND METHOD FOR LAYING FLOORING SYSTEM

CROSS-REFERENCE TO RELATED APPLICATIONS

This application claims priority to PCT/CN2006/000684, filed Apr. 14, 2006.

TECHNICAL FIELD

The present invention relates to a floor panel, a flooring system formed by multiple floor panels and a method for laying the floor panels.

BACKGROUND TECHNOLOGY

Hardwood has been used as a floor covering for several hundred years, and both hardwood floor and wood composite laminate flooring have utilized a conventional tongue-and-groove coupling. In the traditional "tongue-and-groove" structure, a tongue and corresponding groove can be easily coupled by laterally shifting the tongue towards a groove in the same plane. While this provides for easy installation, it also renders the tongue-and-groove joint susceptible to separation by physical or temperature-dependent disturbance of the flooring. Separation is undesirable because it can cause a flooring installation to become disassembled and because it is aesthetically displeasing.

Tongue-and-groove configurations have sought to overcome this undesirable susceptibility to separation by using a tongue-and-groove design which still allows lateral coupling of the tongue and groove, while also providing a locking in the lateral direction. While such a design can overcome much of the susceptibility to separating, these flooring panels can be difficult to install.

SUMMARY OF THE INVENTION

An object of the present invention is to provide a novel "protrusion-recess" structure which not only ensures transverse connection and horizontal locking between a protrusion and a recess but also is installed very easily even at a corner of wall, without decoupling.

As to floor panel, a floor panel comprises: an upper surface; a floor contact surface; a side surface ("a recess end face") having a recess, wherein the side surface comprises an upper lip adjacent to the upper surface, a lower lip and a recess including a upper recess first contact surface, a lower recess second contact surface and a recess guide surface; and a side surface ("a protrusion end face") with a protrusion which includes a upper protrusion first contact surface, a lower protrusion second contact surface and a protrusion guide surface. When the protrusion of one floor panel is placed in the recess of another identical floor panel and a pressure in a direction substantially perpendicular to the upper surface is applied thereto, the pressure makes the protrusion guide surface in contact with the recess guide surface and introduces the protrusion into the recess. And, when the protrusion end face and the recess end face of an identical one of the panel are coupled, the upper protrusion first contact surface engages the upper recess first contact surface to prevent decoupling of the panel in a direction perpendicular to the plane of the upper surface, and the lower protrusion second contact surface engages the lower recess second contact surface to prevent decoupling of the panel in a direction perpendicular to the protrusion end face.

The floor panel can be formed from a wood composite material such as a medium density fiberboard (MDF) or a high density fiberboard (HDF), or natural wood, bamboo material, or other material with certain elasticity.

When the protrusion end face and the recess end face of an identical one of the panel are coupled, a clearance can be formed between the protrusion and the lower recess lip. The lower protrusion contact surface and the lower recess contact surface can be inclined at a 90 degree angle relative to the upper surface.

The thickness of the floor panel can be between about 0.5 cm to about 1.5 cm. The protrusion can extend along substantially the entire length of the protrusion end face. The recess can extend along substantially the entire length of the recess end face. The panel can include an additional recess end face ("second recess end face") and an additional protrusion end face ("second protrusion end face"). A back notch may be provided in the lower surface of the protrusion.

Another solution of the present invention is that a floor panel comprises: an upper surface; a floor contact surface; a side surface ("a recess end face") having a recess, wherein the side surface comprises an upper lip adjacent to the upper surface, a lower lip and a recess including a upper recess first contact surface, a lower recess second contact surface and a recess guide surface; a side surface ("a protrusion end face") having a protrusion, the protrusion of the side surface including a upper protrusion first contact surface, a lower protrusion second contact surface and a protrusion guide surface, wherein a second recess upper lip surface is provided at an outer end of the upper recess first contact surface and joined to the upper recess second contact surface, wherein the recess first upper lip surface is substantially parallel to the recess second upper lip surface; the upper recess first contact surface is substantially parallel to the upper recess second contact surface.

For said floor panel, a second protrusion upper side surface is provided at an outer end of the upper protrusion first contact surface and joined to the upper protrusion second contact surface, wherein the protrusion first upper side surface is substantially parallel to the protrusion second upper side surface, and the upper protrusion first contact surface is substantially parallel to the upper protrusion second contact surface.

The present invention further provides a floor panel, comprising: an upper surface; a floor contact surface; a side surface ("a recess end face") having a recess, wherein the side surface comprises an upper lip adjacent to the upper surface, a lower lip and a recess including a upper recess first contact surface, a lower recess second contact surface and a recess guide surface; a side surface ("a protrusion end face") with a protrusion portion, which includes a upper protrusion first contact surface, a lower protrusion second contact surface and a protrusion guide surface, wherein a back notch is provided in the lower surface of the protrusion.

As to flooring system, a flooring system includes a first floor panel and a second floor panel, the first floor panel comprising: an upper surface; a floor contact surface; a recess end face including: (1) an upper lip adjacent to the upper surface, (2) a lower lip and (3) a recess including a upper first contact surface, a lower second contact surface and a guide surface; the second floor panel including: an upper surface; a floor contact surface; and a protrusion end face, the protrusion of which including a upper first contact surface, a lower second contact surface and a guide surface. When the protrusion of one floor panel is placed in the recess of another identical floor panel and a pressure is applied thereto in a direction substantially perpendicular to the upper surface, the pressure makes the protrusion guide surface in contact with the recess guide surface and introduces the protrusion into the recess. And, when the protrusion end face and the recess end face of an identical one of the panel are coupled, the upper protrusion first contact surface engages the upper recess first contact surface to prevent decoupling of the panel in a direction perpendicular to the plane of the upper surface, and the lower protrusion second contact surface engages the lower recess second contact surface to prevent decoupling of the panel in a direction perpendicular to the protrusion end face.

A clearance can be formed between the protrusion and the lower recess lip. The lower protrusion contact surface and the lower recess contact surface can be inclined at a 90 degree angle relative to the upper surface.

As to method of paving a flooring system, a method of laying a flooring system comprises the step of positioning a first floor panel having the aforesaid features and a second floor panel having the above features. Placing the first floor panel with the floor contact surface thereof on the floor surface or a liner material; placing the second floor panel with the protrusion thereof disposed on the recess lower lip of the first floor panel; applying a pressure to the upper surface in a direction perpendicular to the upper surface to bring the protrusion guide surface in contact with the recess guide surface and introduce the protrusion into the recess.

BRIEF DESCRIPTION OF THE ACCOMPANYING DRAWINGS

All the features of the present invention will be described in detail by virtue of the following embodiments illustrated by the accompanying drawings.

MODES FOR CARRYING OUT THE INVENTION

Figure 1:
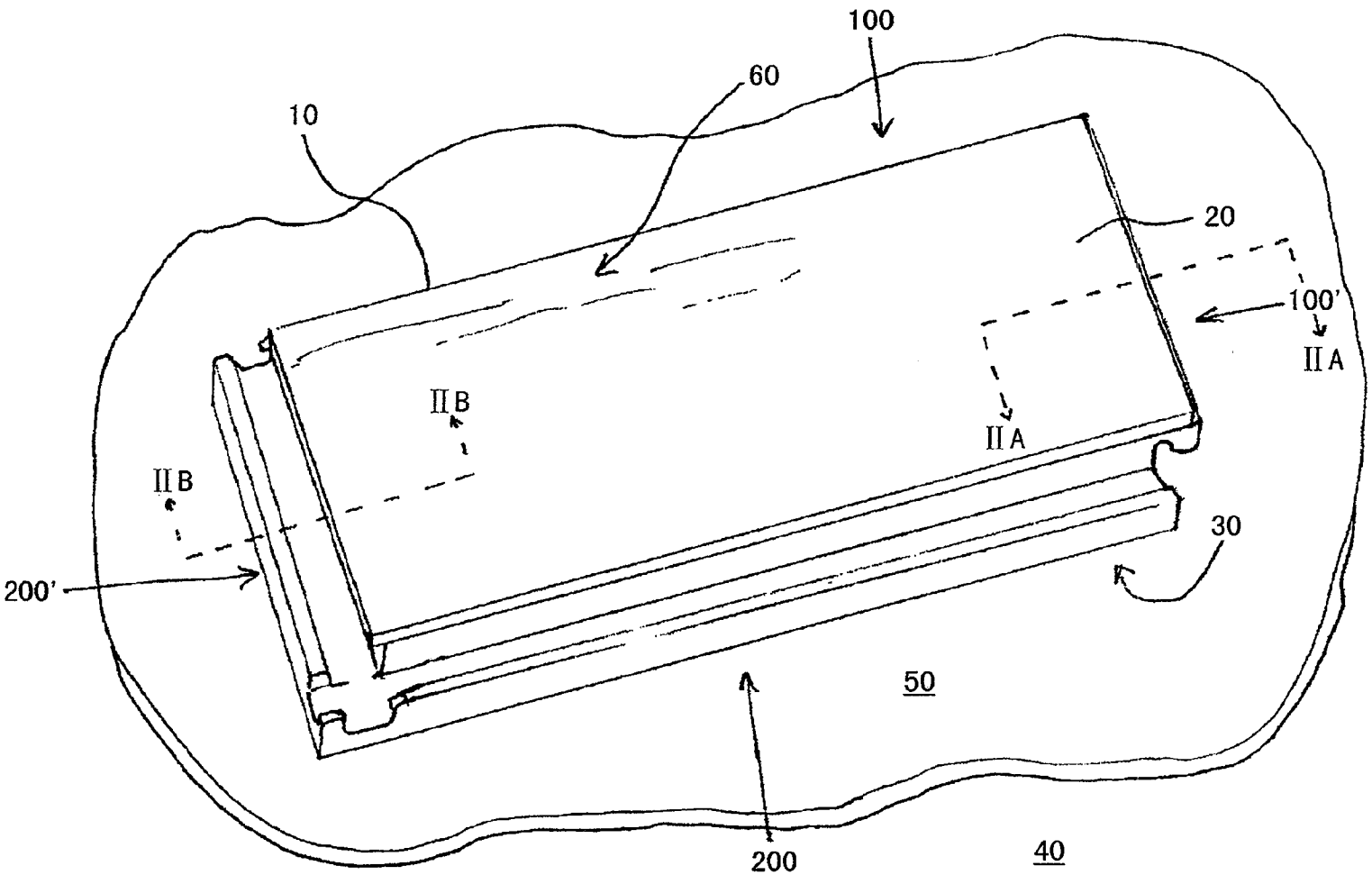
FIG. 1 is a perspective view of a floor panel including a protrusion end face and a recess end face.

In general, referring to FIG. 1, a floor panel 10 has an upper surface and a floor contact surface 30 which preferably are generally disposed in parallel planes. When the floor panel is installed, the floor contact surface 30 contacts the floor 40 upon which the panel is installed, or an underlayment such as a foam underlayment 50, which optionally may be installed between the floor 40 and the floor panel 10. When floor panel 10 is installed, upper surface 20 is visible. Upper surface 20 may include a decoration 60 which is visible when panel 10 is installed.

Decoration 60 can be a simulated wood grain, or any other known decoration. For example, decoration 60 can depict a stone surface. Decoration 60 can include a laminated decoration, and can be formed by any known method, such as laminating a photograph of a wood grain between panel 10 and a plastic coating. Decoration 60 can also include an amount of material such as wood. For example, decoration 60 can be a wood veneer.

Floor panel 10 can be formed from any suitable flooring material, such as wood, wood composite, polymer, or other materials having certain elasticity. If floor panel 10 is formed from wood composite, the wood composite can be medium density fiberboard (MDF) or high density fiberboard (HDF). Floor panel 10 can be formed to provide any suitable size and shape for upper surface 20 and floor contact surface 30. For example, floor panel can be rectangular in shape with dimensions of about 0.2 m wide by about 1.2 m long. Floor panel 10 can be any suitable thickness between upper surface 20 and floor contact surface 30 such as between about 0.5 cm and about 1.5 cm.

As shown in FIG. 1, floor panel 10 includes protrusion end face 100 and recess end face 200. In the exemplary preferred embodiment, protrusion end face 100 and recess end face 200 are opposing sides of a floor panel 10. When floor panel 10 includes two protrusion end faces 100, 100' and two recess end faces 200, 200', protrusion end faces 100, 100' are provided at adjacent edges of floor panel 10 and recess end faces 200, 200' are provided at adjacent edges of floor panel 10, as shown in FIG. 1. A plurality of floor panels 10 are installed together to form a flooring system by connecting the protrusion end face 100 or 100' of each floor panel to the recess end face 200 or 200' of at least another floor panel. Although floor panel 10 includes a pair of protrusion end faces 100, 100', each opposite a corresponding recess end faces 200, 200'; floor panel 10 can instead include one protrusion end face 100 and one opposite recess end face 200. Another exemplary embodiment of panels according to the present invention may have only a single protrusion end face 100 or recess end face 200 but not both. Such panels, for example, may be placed against walls or in corners formed by adjacent walls. Yet other exemplary embodiments of panels according to the present invention may have more than one protrusion end face 100 but only one recess end face 200, or more than one recess end face 200, but only one protrusion end face 100.

Figure 2A:
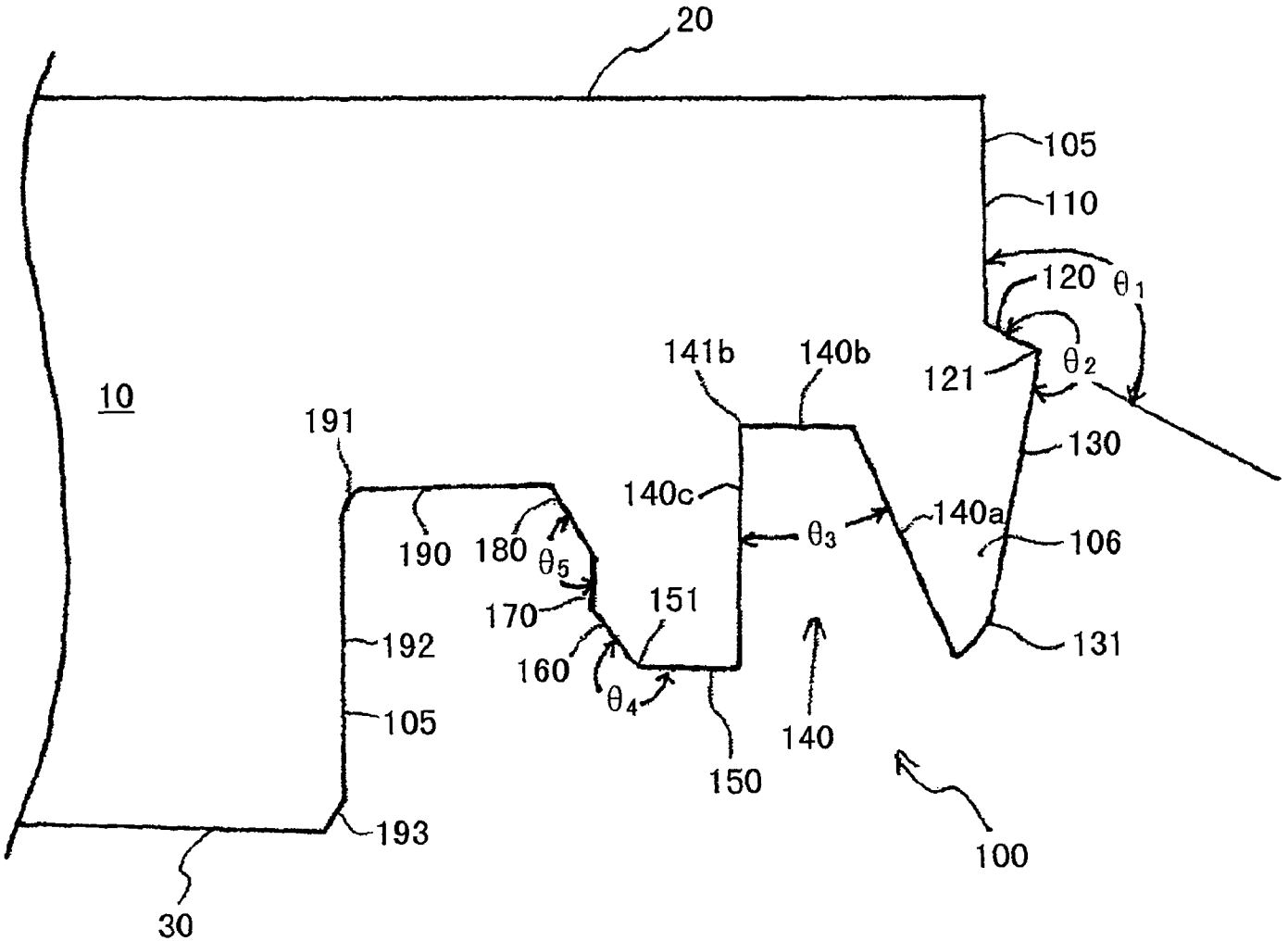
FIG. 2A is a cross-sectional side view of a protrusion end face of a floor panel of FIG. 1.

Referring to FIG. 2A, a view of protrusion end face 100 taken through cross section IIA-IIA of floor panel 10 is depicted. In the exemplary embodiment, floor panel 10 has a thickness T1 between upper surface 20 and floor contact surface 30 of about 5.0 mm to about 15.0 mm and more preferably about 8.2 mm or 12.3 mm. As shown in FIG. 2A, protrusion end face 100 is characterized by a periphery formed between upper surface 20 and floor contact surface 30 in floor panel. The curve or protrusion periphery 105 can include a sequence of planes, curved surfaces and features formed between upper surface 20 and floor contact surface 30.

Referring to FIG. 2A, protrusion upper side surface 110 is shown adjacent and perpendicular to upper surface 20. In the exemplary embodiment, protrusion upper side surface 110 can be planar and can extend from upper surface 20 about 2.0 mm to about 3.0 mm, preferably about 2.3 mm. Adjacent to protrusion upper side surface 110 is an upper protrusion first contact surface 120, which extends from an end of protrusion upper side surface 110 about 0.5 mm to about 1.0 mm, and preferably about 0.65 mm. Upper protrusion first contact surface may be disposed at an angle θ1 of about 90 degrees to about 135 degrees, and preferably about 110 degrees, with respect to protrusion upper side surface 110. Preferably, upper protrusion first contact surface terminates in an arcuate transition or radius 121.

Adjacent to the upper protrusion first contact surface 120 is a protrusion leading surface 130 which extends from the upper protrusion first contact surface 120 towards the floor contact surface 30 and ends up at a arcuate transition or radius 131 and is adjacent to a next technical feature, e.g., a back notch 140 or a protrusion bottom surface 150 on the protrusion periphery 105. During installation, the interior of the back notch can generate certain elasticity and tensile force, which on the one hand greatly reduces the drawback of downward bending of a lower lip of the recess, and on the other hand the tensile force can ensure good contact of the contact portions of the protrusion and recess when installed in place. Meanwhile, since the back notch is provided substantially in a direction vertical to the floor or in a slightly deviating direction, it cannot apparently reduce the strength of the protrusion.

As shown in FIG. 2A, back notch 140 can include three back notch surfaces: first back notch surface 140*a*, second back notch surface 140*b*, and third back notch surface 140*c*. First back notch surface 140*a* can extend from an end of arcuate transition 131 of protrusion leading surface 130 a length of about 2.5 mm to about 3.5 mm and preferably about 3.0 mm. The first back notch surface 140*a* can be parallel to the third back notch surface 140*c* or can be angled. The second back notch surface 140*b* has a length of between about 1.0 mm and about 2.0 mm, preferably about 1.5 mm. The back notch 140 has a transition 141*b* formed by the second back notch surface 140*b* and the third back notch surface 140*c*, the transition 141*b* being either sharp-angled or chamfered. Adjacent to third back notch surface 140*c*, protrusion bottom surface 150 extends, for example, substantially parallel to the plane of upper surface 20 and/or floor contact surface 30 a length of about 1.0 mm to about 3.0 mm and in the exemplary embodiment preferably about 2.0 mm. Protrusion bottom surface 150 can include a sharp or arcuate transition 151 adjacent to the next feature of protrusion periphery 105, which can be a protrusion guide surface 160. The angle between the protrusion guide surface 160 and the protrusion bottom surface 150 is $\theta_4$ which is between 190 degrees and 270 degrees, preferably 240 degrees.

Adjacent to an end of protrusion guide surface 160 may be a lower protrusion contact surface 170, which for example can extend about 0.1 to about 1.0 mm in length and preferably about 0.3 mm. Lower protrusion contact surface 170 for example can be substantially perpendicular to the upper surface 20 and/or floor contact surface 30 Adjacent to and at an end of lower protrusion contact surface 170 may be a protrusion boundary surface 180, and can be parallel to the plane of protrusion guide surface 160. Protrusion boundary surface 180 terminates at a first protrusion nesting surface 190, which can be substantially parallel to the upper surface 20 and/or floor contact surface 30 and can terminate in a sharp or arcuate transition 191. A second protrusion nesting surface 192 extends from first protrusion nesting surface 190 to floor contact surface 30, and can be perpendicular to the upper surface 20 and/or floor contact surface 30. Preferably, a planar transition 193 is formed between second protrusion nesting surface 192 and floor contact surface 30 and is disposed transverse to the plane of floor contact surface 30.

Therefore, the protrusion 106 is defined by the protrusion periphery 105 between the upper surface 20 and the floor contact surface 30 and begins from the protrusion upper side surface 110 perpendicular to the upper surface 20.

Figure 2B:
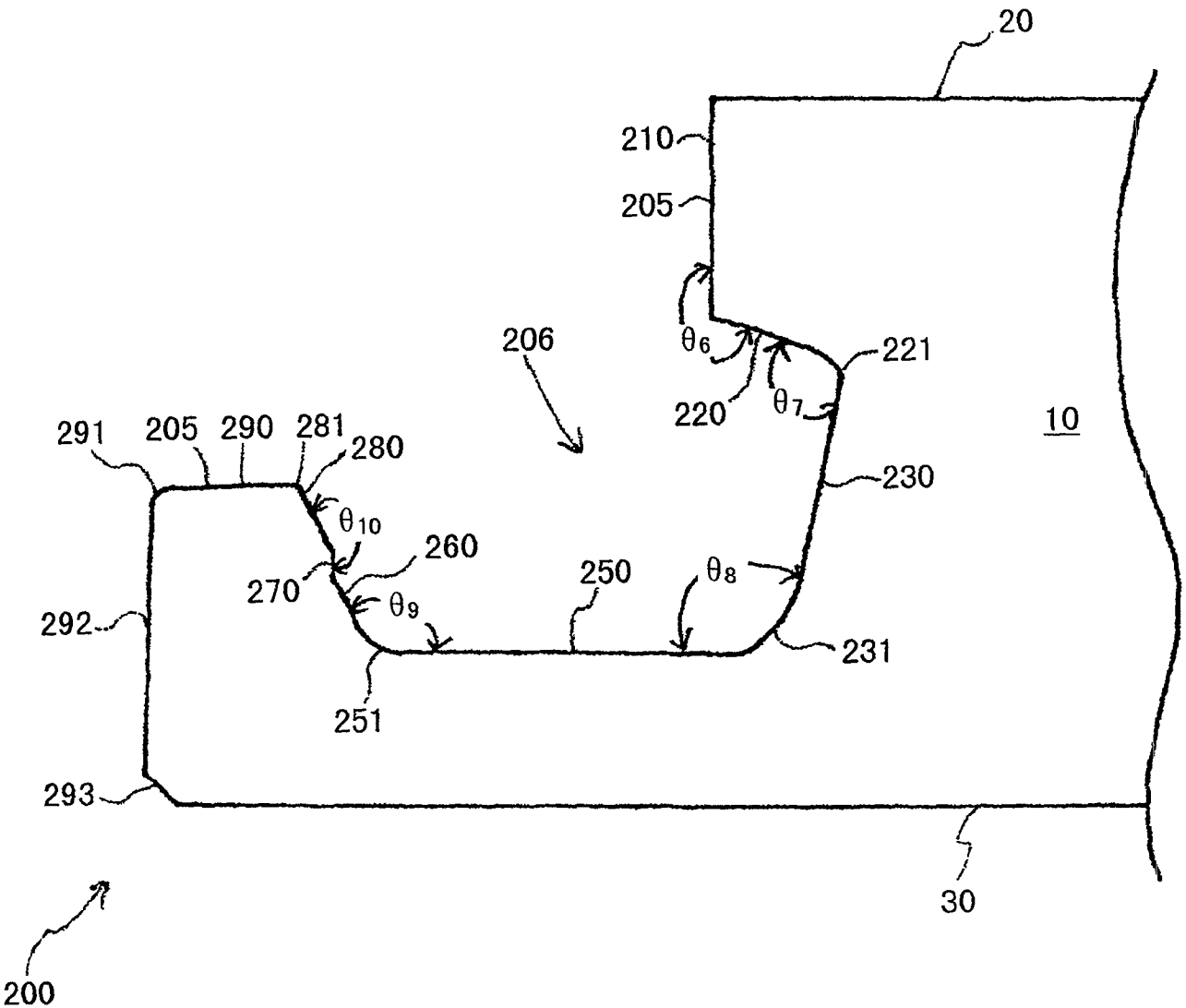
FIG. 2B is a cross-sectional side view of a recess end face of a floor panel of FIG. 1.

Referring now to FIG. 2B, a view of recess end face 200 taken through cross section IIB-IIB of floor panel 10 is depicted. Again, floor panel 10 has a thickness T1. As shown in FIG. 2B, recess end face 200 is characterized by a periphery formed between upper surface 20 and floor contact surface 30. Recess periphery 205 can include a sequence of planes, curved surfaces and features formed between upper surface 20 and floor contact surface 30. Recess periphery 205 preferably is configured and dimensioned to be coupled with a protrusion periphery 105.

Recess end face upper lip 210 is shown adjacent and perpendicular to upper surface 20. Recess end face upper lip 210, for example, can be planar and can extend from upper surface 20 about 2.0 mm to about 3.0 mm in length, and preferably about 2.3 mm. Adjacent to recess end face upper lip 210 is an upper recess contact surface 220, which extends from an end of recess end face upper lip 210 about 0.5 mm to about 2.0 mm in length, and preferably about 1.3 mm. Surfaces 210, 220 for example may be disposed at an angle θ6 between about 210 degrees and about 270 degrees, and more preferably about 250 degrees, with respect to one another. Preferably, upper recess contact surface 220 terminates in a sharp or arcuate transition 221.

Adjacent to upper recess contact surface 220 is a recess leading surface 230. Recess leading surface 230 thus extends from the end of upper recess contact surface 220 toward the plane of floor contact surface 30 and transverse thereto, and can terminate for example in an arcuate transition 231 adjacent to the next feature of recess periphery 205, which can be a recess bottom surface 250.

As shown in FIG. 2B, recess bottom surface 250 may extend substantially parallel to the upper surface 20 and/or floor contact surface 30. Recess bottom surface 250 for example may extend a length of about 4.0 mm to about 8.0 mm and preferably about 6.0 mm. Recess bottom surface 250 can include an arcuate transition 251 adjacent to the next feature of recess periphery 205, which can be a recess boundary surface 260. An angle between the recess boundary surface 260 and the recess bottom surface 250 is $\theta_9$ which is in the range of from 100 degrees to 150 degrees, preferably about 120 degrees.

Adjacent to recess boundary surface 260 is a lower recess contact surface 270, which can extend about 0.1 to about 1.0 mm, preferably about 0.3 mm. Lower recess contact surface 270 for example can be substantially perpendicular to the plane of upper surface 20 and/or floor contact surface 30. Adjacent to and at an end of lower recess contact surface 270 may be a recess guide surface 280, which can be parallel to the plane of recess boundary surface 260. The recess guide surface 280 can comprise a sharp or arcuate transition 281.

Adjacent to an end of recess guide surface 280 may be a first recess nesting surface 290. First recess nesting surface 290 can be substantially parallel to the plane of upper surface 20 and/or floor contact surface 30, and can include a sharp or arcuate transition 291. A second recess nesting surface 292 extends from first recess nesting surface 290 to floor contact surface 30, and can be perpendicular to the upper surface 20 and/or floor contact surface 30. Preferably, a planar transition 293 is formed between second recess nesting surface 292 and floor contact surface 30 and is disposed transverse to the plane of floor contact surface 30.

Thus, a recess 206 is defined by recess periphery 205 between upper surface 20 and floor contact surface 30, and for example extends from the plane perpendicular to the upper surface 20 and tangent to sharp or arcuate transition 221. Recess periphery 205 shown in FIG. 2B includes features that cooperate with features included in protrusion periphery 105 described above.

As described above, floor panel 10 depicted in FIGS. 2A and 2B has a thickness of for example about 8.2 mm. Floor panel 10 can be formed in any desired other thickness, e.g., 12.3 mm. It should be apparent that the dimensions described above can be adjusted as required.

The periphery of the floor panels 10 can be shaped by a known milling process. A milling machine can comprise a milling cutter for forming technical features of the protrusion and recess. For example, a portion of an unprocessed floor panel 10 having quadrilateral edges is removed by the milling cutter to produce a desired contour. Multiple passes may be made to form the desired profiles. Where floor panel 10 is rectangular, it can be milled on two opposite sides simultaneously.

Figure 3:
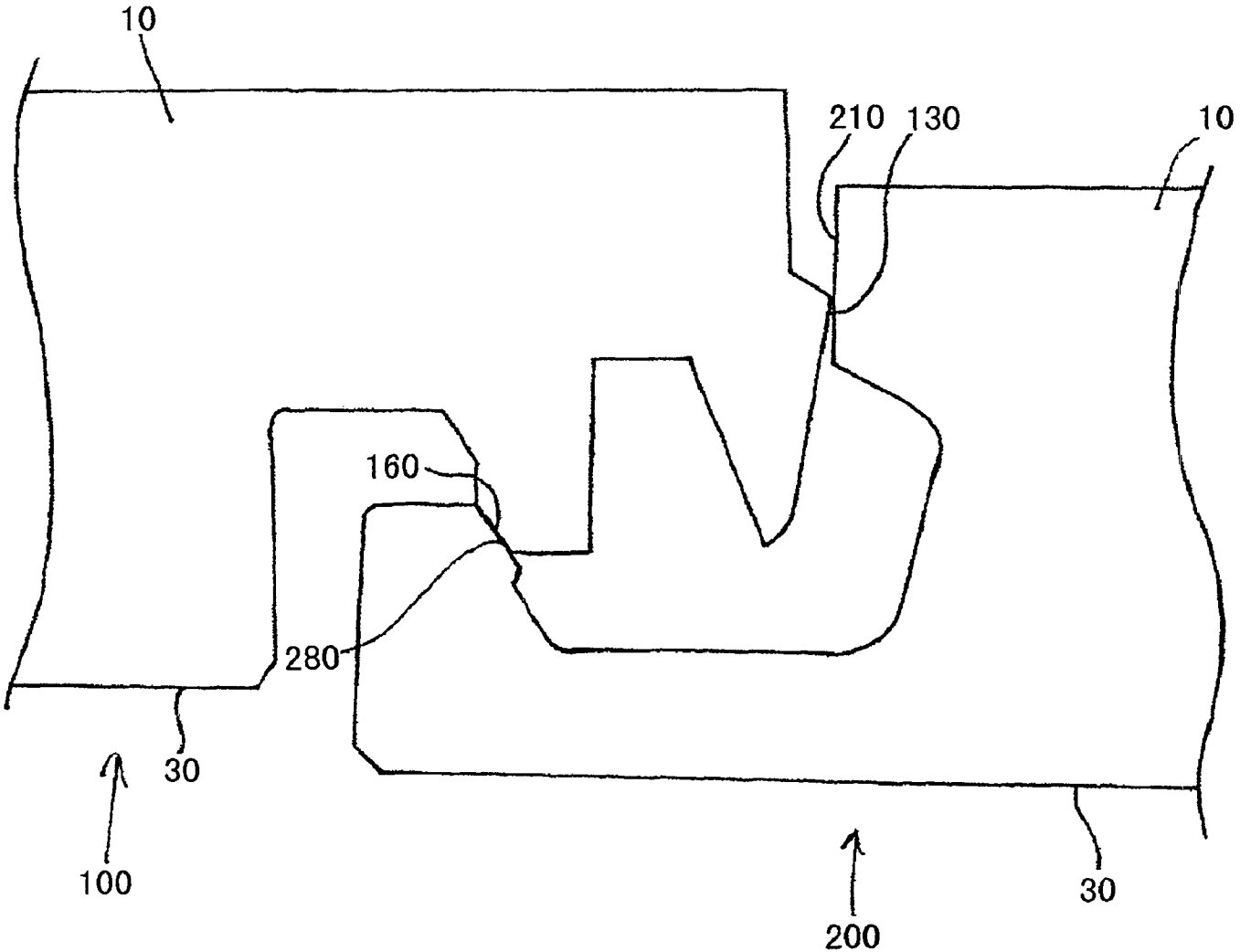
FIG. 3 is a first cross-sectional side view of the coupling protrusion end face of FIG. 2A partially engaging the recess end face of FIG. 2B.

Referring now to FIG. 3, protrusion end face 100 of a first floor panel 10 and recess end face 200 of an adjacent panel are positioned for coupling. In one exemplary preferred installation, a first floor panel 10 including a recess end face 200 is positioned such that floor contact surface 30 thereof is disposed in contact with a floor or more preferably in contact with an underlayment positioned over the floor. The floor panel 10 including the protrusion end face 100 is placed beside the recess end face 200 in a manner that the arcuate transition or radius 121 is in contact with part of the recess upper lip surface 210 and meanwhile part of the protrusion guide surface 160 of the protrusion is placed on at least part of the recess guide surface 280 of the recess. As depicted in FIG. 3, the two floor panels 10 are substantially parallel.

Figure 4:
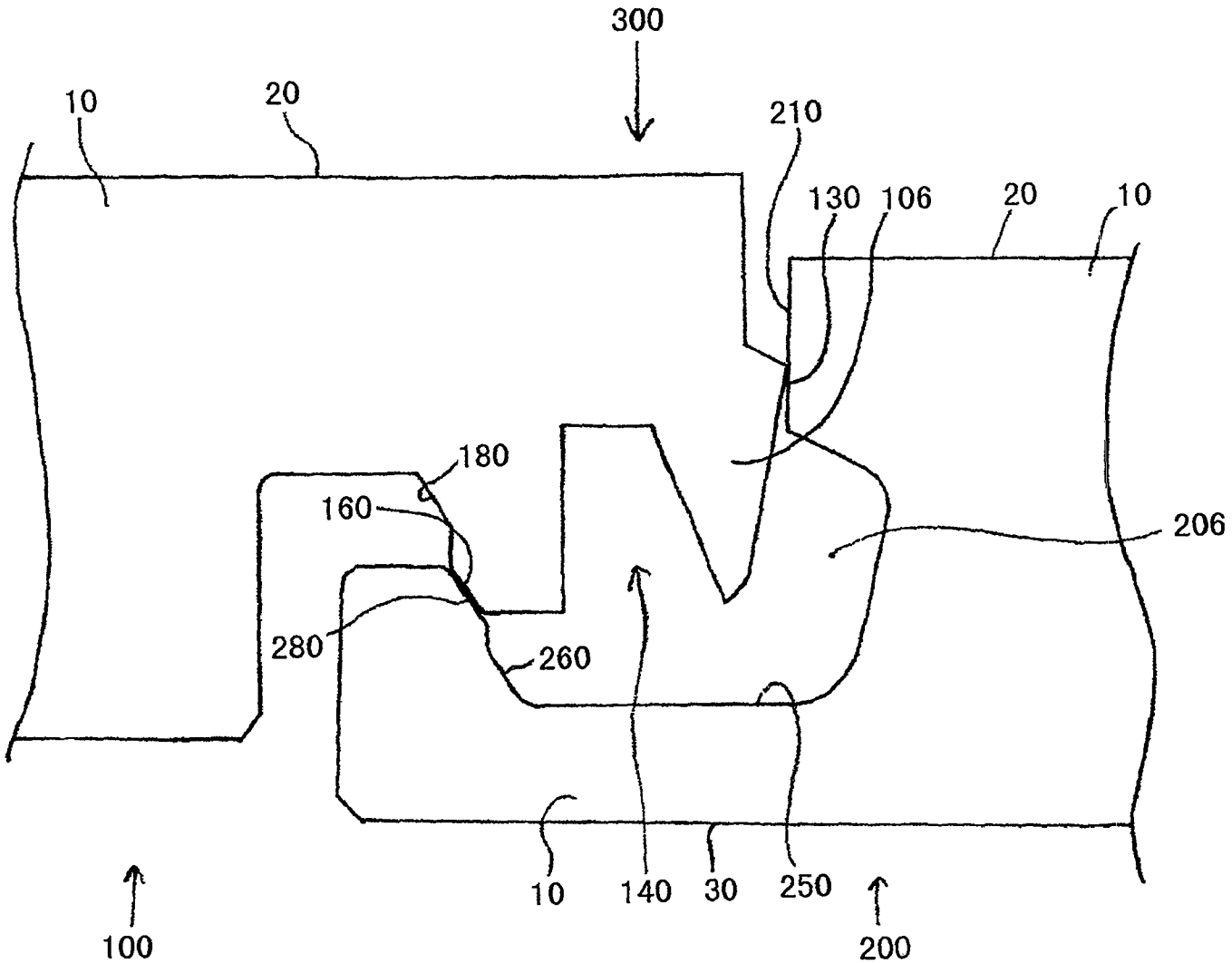
FIG. 4 is another cross-sectional side view of the coupling protrusion end face of FIG. 2A partially engaging the recess end face of FIG. 2B.

FIG. 4 depicts a force 300, directed for example substantially perpendicular to the plane of the floor and being applied to the upper surface 20 of floor panel 10 including protrusion end face 100. Force 300 can be pressure applied manually or with a too. Force 300 causes a portion of protrusion leading surface 130 to press against a portion of recess end face upper lip 210 and a portion of protrusion guide surface 160 to press against recess guide surface 280. Recess guide surface 280 slopes inward toward the floor panel that includes recess end face 200 and downwardly toward floor contact surface 30.

As force 300 continues to be applied to floor panel 10, protrusion guide surface 160 slides inward and downward along recess guide surface 280, and a portion of protrusion leading surface 130 slides away from upper surface 20 along recess end face upper lip 210. This causes protrusion 106 to translate in a wedgelike manner into recess 206. The wedgelike insertion of protrusion 106 into recess 206 can also cause a deformation of back notch 140 in protrusion 106 to decrease the size of protrusion 106 during coupling. The deflection or deformation of part of either the protrusion end face 100 or recess end face 200 occurs to a sufficient degree to allow protrusion 106 to pass recess guide surface 280 into recess 206 and protrusion leading surface 130 to pass recess end face upper lip 210 into recess 206. At this point, adjacent floor panels 10 are coupled to one another with protrusion 106 securely engaged in recess 206.

Figure 5:
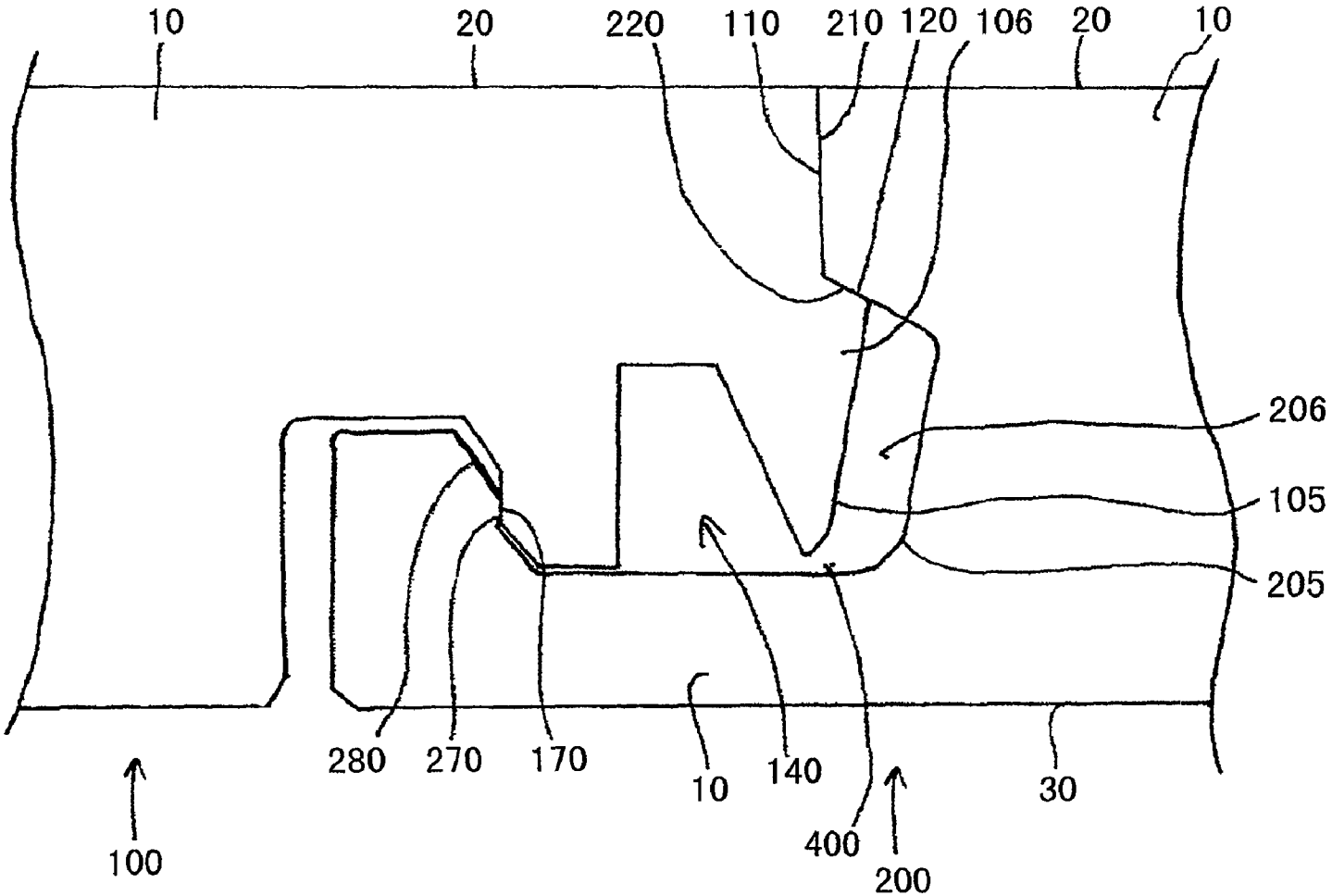
FIG. 5 is a cross-sectional side view of the protrusion end face of FIG. 2A coupled to the recess end face of FIG. 2B.

FIG. 5 depicts protrusion 106 of protrusion end face 100 of a first panel 10 engaged in recess 206 of recess end face 200 of a second floor panel 10. When coupled, protrusion upper side surface 110 is adjacent recess end face upper lip 210 such that there is substantially no space between the upper surfaces of the two panels.

On completion of connection, the upper protrusion first contact surface 120 of the protrusion mates with the upper recess contact surface 220 of the recess to prevent disengagement of the floor panels 10 in a direction perpendicular to the upper surface 20. When installed, this prevents floor panel 10 having protrusion end face 100 from moving upwards away from floor 40. As shown in FIG. 5, lower protrusion contact surface 170 cooperates with lower recess contact surface 270 to prevent decoupling of the panels in a direction perpendicular to the protrusion end face. When installed, this prevents floor panel 10 having protrusion end face 100 from moving away from the floor panel 10 having recess end face 200 to form a space between the upper surfaces 20 of the panels.

Lower protrusion contact surface 170 and lower recess contact surface 270 can be perpendicular to the plane of upper surface 20 and floor contact surface 30.

Protrusion 106 and recess 206 can be milled such that recess lower lip 212 is not deflected and back notch 140 is not deformed when the panels are coupled in installed position as shown in FIG. 5. When protrusion end face 100 is coupled with recess end face 200, clearance 400 can be formed between protrusion periphery 105 and recess periphery 205. It should also be noted that the specific dimensions of protrusion end face 100 and recess end face 200, including protrusion 106 and recess 206, can vary based on factors such as the material and thickness of floor panels 10.

Figure 6:
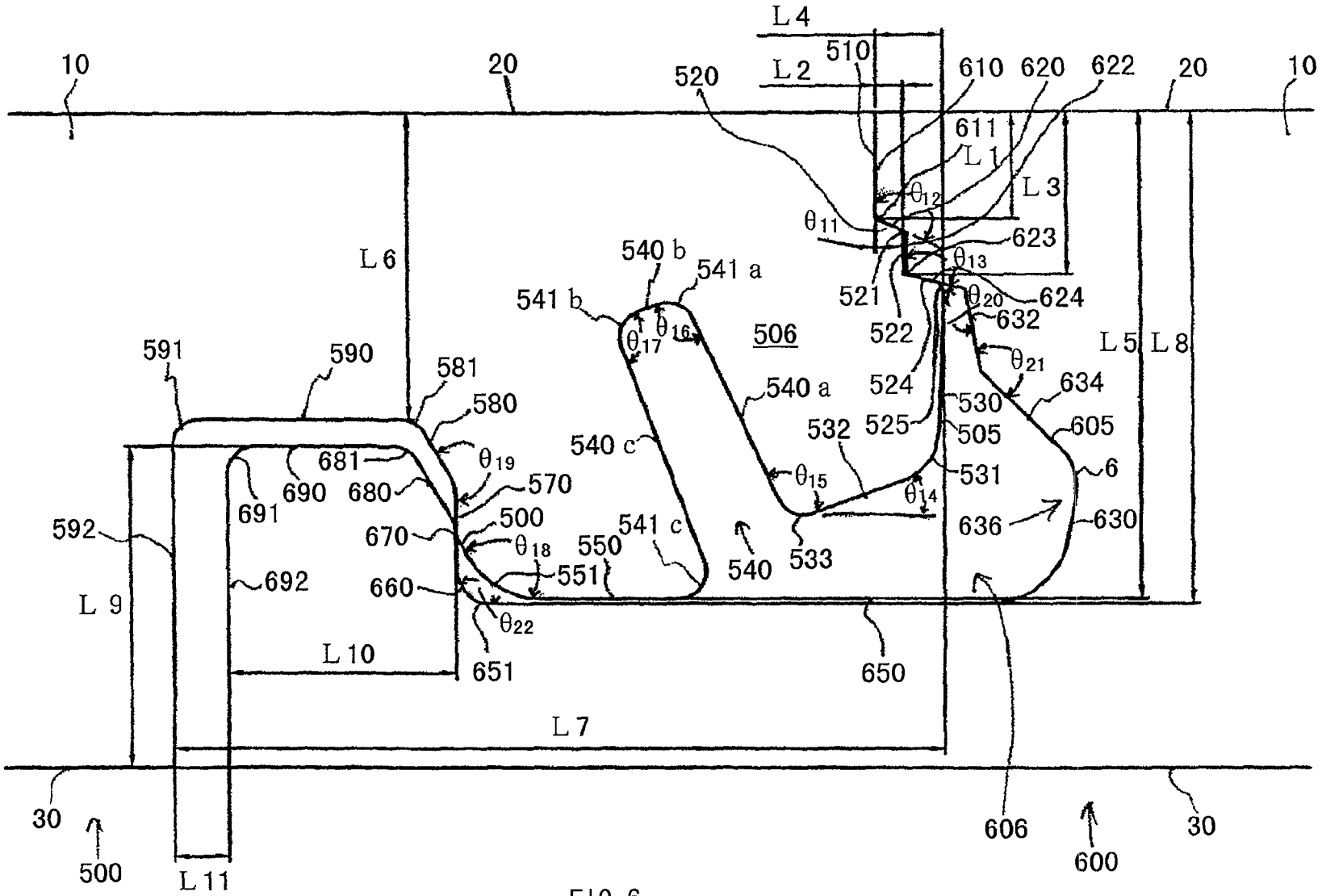
FIG. 6 is a cross-sectional side view of a second exemplary embodiment of a coupled protrusion end face and recess end face.

FIG. 6 depicts a second preferred embodiment of a coupled protrusion end face 500 and recess end face 600. Here, floor panel 10 has a thickness T3 between upper surface 20 and floor contact surface 30 As shown in FIG. 6, protrusion end face 500 is characterized by a curve or protrusion periphery 505 formed between upper surface 20 and floor contact surface 30 Recess end face 600 is characterized by a recess periphery 605 formed between upper surface 20 and floor contact surface 30. The curve or protrusion periphery 505 and recess periphery 605 can include a sequence of planes, curved surfaces and features formed between upper surface 20 and floor contact surface 30.

Protrusion upper lip surface 510 and recess upper lip surface 610 are shown adjacent to upper surface 20 and may be disposed at an angle θ11 of about 0 degrees to about 5 degrees, preferably about 1 degree, with respect to one another. Surfaces 510, 610 can be planar and can extend from upper surface 20 a distance about 1.0 mm to about 3.0 mm, preferably about 2.0 mm. Recess upper lip surface 610 preferably terminates in a sharp or arcuate transition 611.

Adjacent to the protrusion upper lip surface 510 is an upper protrusion first contact surface 520. As shown in FIG. 6, upper recess contact surface 620 can be provided for example adjacent to recess upper lip surface 610 such that surface 620 is substantially coplanar and contiguous with upper protrusion first contact surface 520 in coupled condition.

Upper protrusion first contact surface 520 may extend a depth L2 of about 0.1 to about 1.0 mm, preferably about 0.5 mm from protrusion upper lip surface 510, and may include sharp or arcuate transition 521 adjacent to the next feature of curve or protrusion periphery 505, which can be second protrusion upper lip surface 522. Surface 522 can be substantially perpendicular to upper surface 20 and/or floor contact surface 30. As shown in FIG. 6, surface 620 is adjacent to second recess upper lip surface 622. Surface 622 can be for example parallel to and configured to second protrusion upper lip surface 522 when floor panels 10 are in a coupled condition. The second upper side surface 522 of the protrusion and the second upper lip surface 622 of the recess can extend between 0.1 mm and 1.0 mm, preferably 0.5 mm. Surface 622 can include a sharp or arcuate transition 623.

Adjacent to surface 522 is a second protrusion upper contact surface 524. The second protrusion upper contact surface 524 is generally parallel to the upper protrusion first contact surface 520 of the protrusion and can extend from the protrusion upper lip surface 510 of the protrusion about 0.5 mm to 1.5 mm, preferably about 1.2 mm. Surface 524 can include sharp or arcuate transition 525. As shown in FIG. 6, second upper recess contact surface 624 can be provided for example adjacent to surface 622 such that surface 624 is substantially coplanar and contiguous with surface 524 in coupled condition.

Adjacent to surface 524 is protrusion leading surface 530. Surface 624 extends beyond surface 530. In the well installed state as shown in FIG. 6, along the curve or protrusion periphery 505 of the protrusion and the recess periphery 605 of the recess, no contact points are preferably provided in the segment from this point to the contact point between a lower protrusion contact surface 570 of the protrusion and a lower third contact surface 670 of the recess.

In the segment from the upper protrusion first contact surface 520 of the protrusion, the second upper side surface 522 of the protrusion to the upper second contact surface 524 of the protrusion, the periphery of protrusion 506 substantially forms a stepped shape, which greatly facilitates installation.

Along the curve or protrusion periphery 505, the protrusion leading surface 530 of the protrusion begins with the upper second contact surface 524 of the protrusion. Surface 530 can include sharp or arcuate transition 531 and a second planar portion 532. Second planar portion 532 of the protrusion leading surface 530 can comprise a sharp or arcuate transition 533.

Adjacent to surface 530 is back notch 540, which can include three back notch surfaces: first back notch surface 540*a*, second back notch surface 540*b*, and third back notch surface 540*c*. First notch surface 540*a* can extend from transition 533 and can include a sharp or arcuate transition 541*a*.

Adjacent to surface 540*a* second back notch surface 540*b* can extend from about 0.5 mm to about 1.5 mm, preferably about 1.0 mm. Second back notch surface 540*b* can include a sharp or arcuate transition 541*b*.

Adjacent to surface 540*b* third back notch surface 540*c* can include sharp or arcuate transition 541*c*.

Adjacent to arcuate transition 541*c*, protrusion bottom surface 550 extends, for example, substantially parallel to upper surface 20 and/or floor contact surface 30. Protrusion bottom surface 550 can include a sharp or arcuate transition 551 adjacent to the next feature of curve or protrusion periphery 505, which can be a protrusion guide surface 560. Protrusion guide surface 560 can be disposed at an angle θ18 of between about 90 degrees and about 150 degrees, preferably about 120 degrees, with respect to surface 550.

Adjacent to an end of protrusion guide surface 560 may be a lower protrusion contact surface 570, which for example can extend about 0.1 to about 1.0 mm and preferably about 0.3 mm. Lower protrusion contact surface 570 for example can be substantially perpendicular to the plane of upper surface 20 and/or floor contact surface 30. Adjacent to an end of lower protrusion contact surface 570 may be a protrusion boundary surface 580, which can be parallel to the plane of protrusion guide surface 560.

The protrusion boundary surface 580 of the protrusion terminates at a first transition surface 590 of the protrusion. Surface 590 can be substantially parallel to the plane of upper surface 20 and/or floor contact surface 30. Surface 590 can include sharp or arcuate transition 591. A second nesting surface 592 extends from first protrusion nesting surface 590 to floor contact surface 30, and can be perpendicular to upper surface 20 and/or floor contact surface 30.

Therefore, the protrusion 506 is defined by the curve or protrusion periphery 505 of the protrusion located between the upper surface 20 and the floor contact surface 30 and can begin with protrusion upper lip surface 510 of the protrusion perpendicular to the upper surface 20.

As discussed above, second recess upper contact surface 624 extends beyond second protrusion upper contact surface 524 in coupled condition. Adjacent to surface 624 is a recess side surface 630. Recess side surface 630 can include a first planar portion 632.

Adjacent to first planar portion 632 second planar portion 634 may be disposed at an angle θ21 between about 90 degrees and about 160 degrees, preferably about 140 degrees, with respect to first planar portion 632. Recess side surface 630 can also include a curvilinear portion 636 adjacent to an end of second planar portion 634, which may include multiple planar and curved surfaces as required.

As shown in FIG. 6, closely adjacent to the recess side surface 630 is a recess bottom surface 650 which can be substantially parallel to the upper surface 20 and/or the floor contact surface 30. Recess bottom surface 650 can include a sharp or arcuate transition 651 adjacent to the next feature of recess periphery 605, which can be a recess boundary surface 660.

The angle between the recess boundary surface 660 and the recess bottom surface 650 is $\theta_{22}$ which is between 90 degrees and 150 degrees, preferably 120 degrees.

Adjacent to recess boundary surface 660 lower recess contact surface 670 extends about 0.1 to about 1.0 mm in length, preferably about 0.3 mm. Surface 670 can be substantially perpendicular to the plane of upper surface 20 and/or floor contact surface 30. Adjacent to surface 670 is recess boundary surface 680, which can be parallel to the plane of surface 660. Preferably, surface 680 terminates in sharp or arcuate transition 681.

Adjacent to one end of the recess boundary surface 680 is a first recess nesting surface 690 which can be generally parallel to the upper surface 20 and/or the floor contact surface 30 and terminates at a sharp or arcuate transition 691. A second recess nesting surface 692 extends from the first recess transition surface 690 to the floor contact surface 30 and can be substantially perpendicular to the upper surface 20 and/or the floor contact surface 30.

Therefore, a recess 606 is defined by a recess periphery 605 between the upper surface 20 and the floor contact surface 30 and can extend to a vertical surface which is tangential to the recess side surface 630 and substantially perpendicular to the upper surface 20 and/or the floor contact surface 30. The technical features on the recess periphery 605 can mate with the technical features on the curve or protrusion periphery 505.

Figure 7:
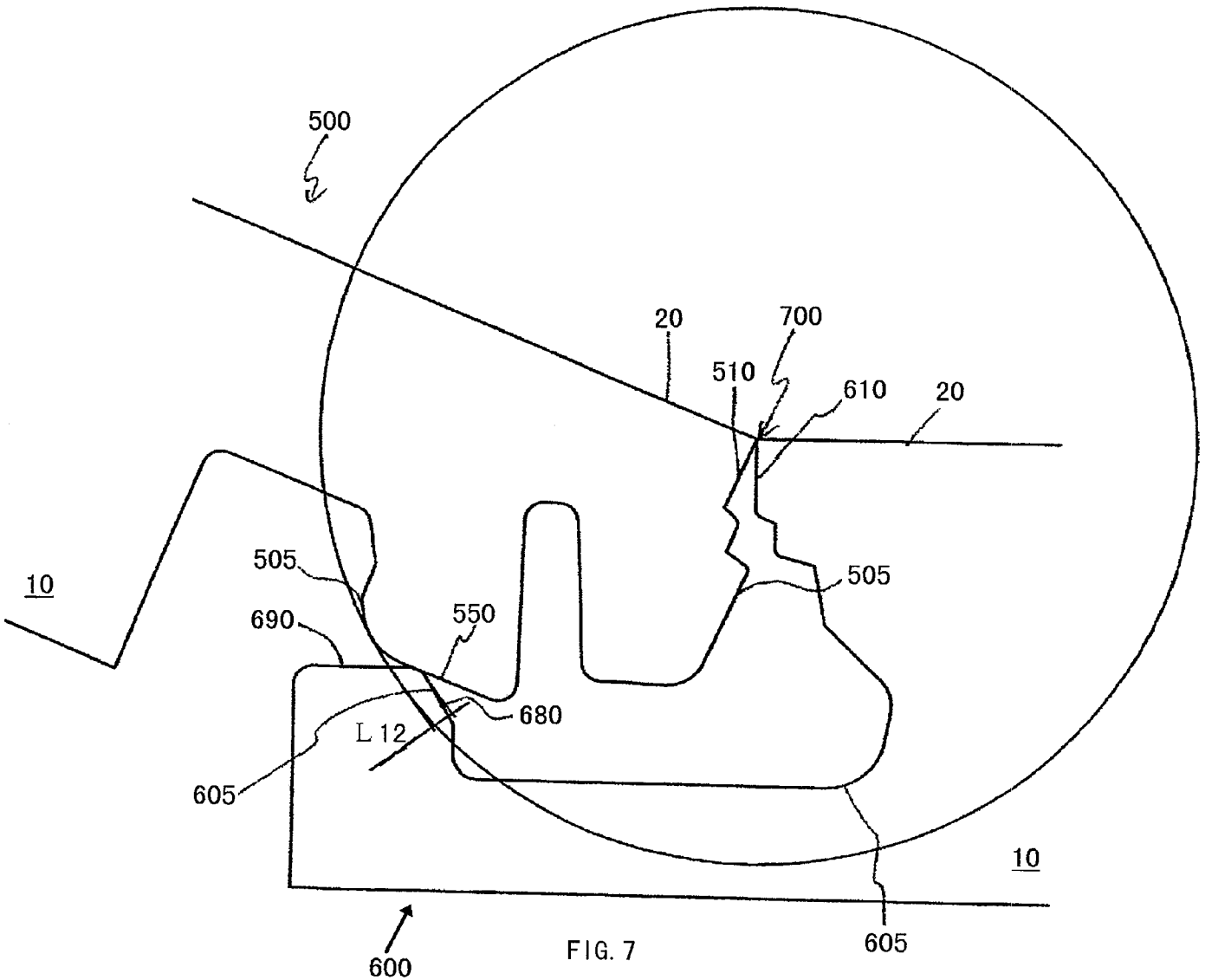
FIG. 7 is a first cross-sectional side view of another embodiment of a protrusion end face and recess end face positioned for initial engagement.
Figure 8:
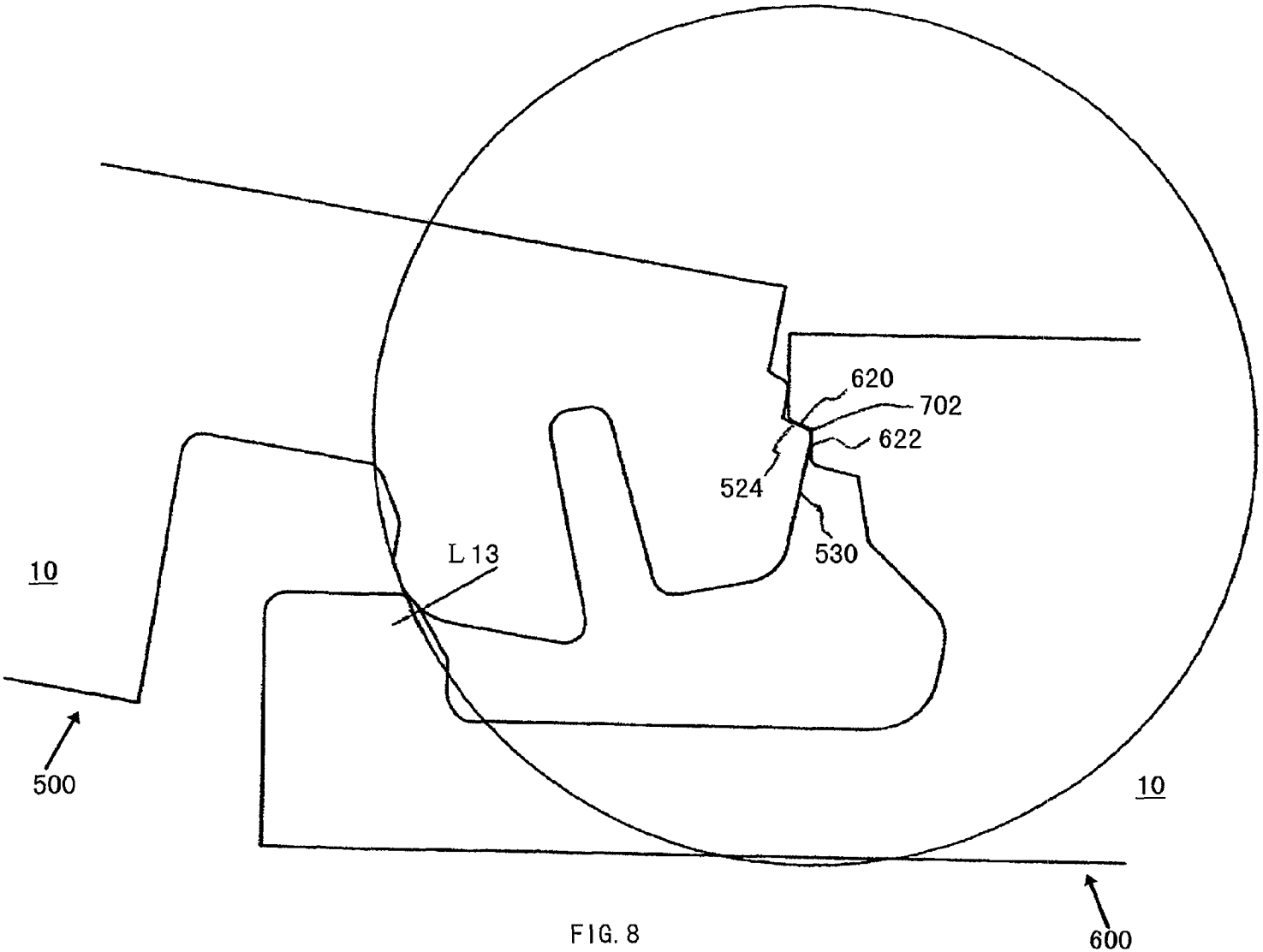
FIG. 8 is a second cross-sectional side view of the embodiment of FIG. 7 in partial engagement, showing that the protrusion end face is already partially installed in the recess end face.
Figure 9:
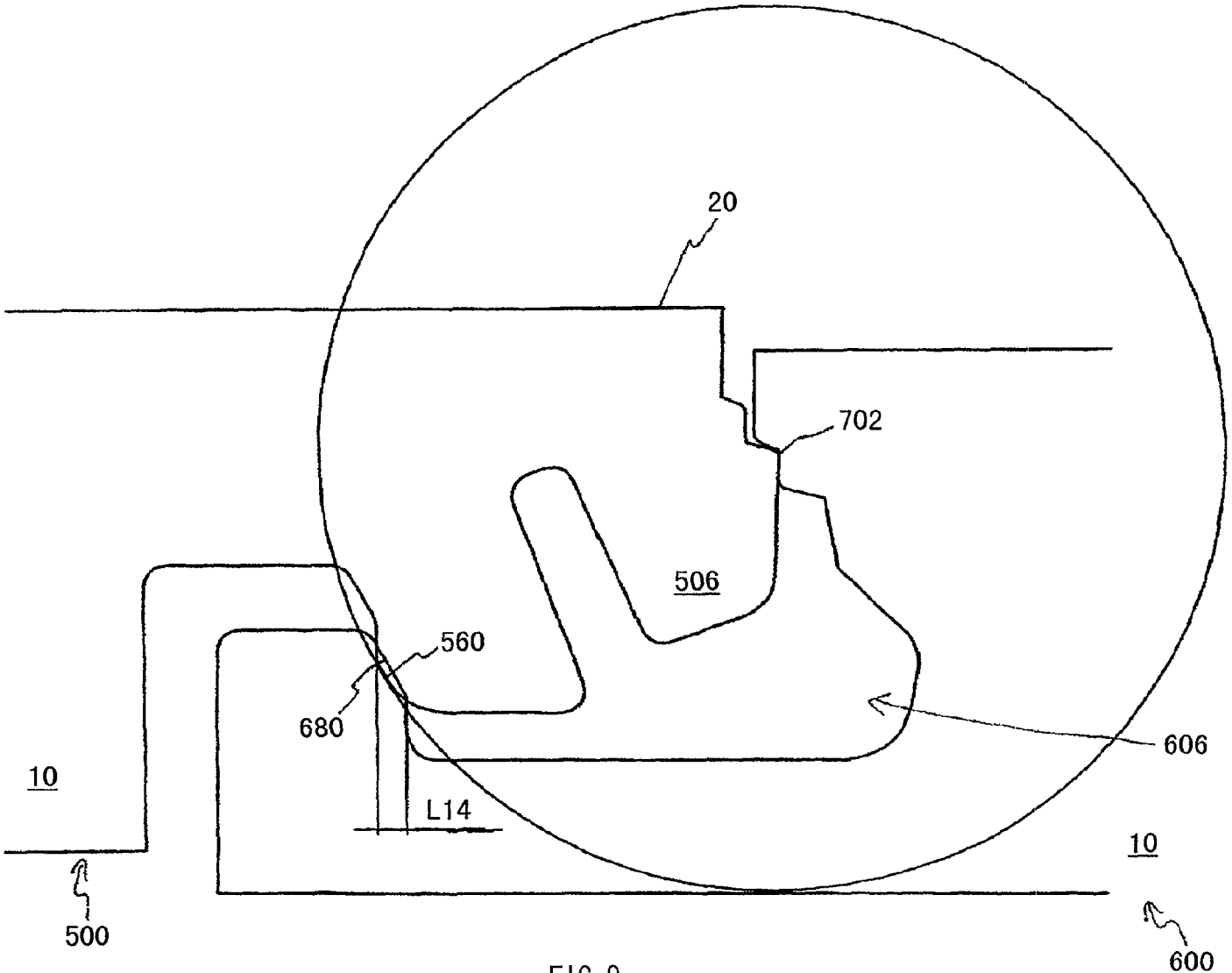
FIG. 9 is a third cross-sectional side view of the embodiment of FIG. 7 in partial engagement, showing that the protrusion end face is already partially installed in the recess end face.

FIGS. 7-9 depict various steps for coupling protrusion end face 500 and recess end face 600 described in reference to FIG. 6. Referring to FIG. 7, floor panel 10 including protrusion end face 500 can be positioned such that a rotational axis 700 is present at the juncture of upper surface 20 and protrusion upper lip surface 510 of protrusion end face 500, adjacent to the juncture of upper surface 20 and recess upper lip surface 610 of recess end face 600. The protrusion bottom surface 550 abuts against a junction point between the recess boundary surface 680 and the recess first transition surface 690. FIG. 7 demonstrates that coupling protrusion end face 500 with recess end face 600 by rotation about axis 700 would require a significant displacement L12 of a portion of recess end face 600 of about 6.3 mm.

In FIG. 8, a second rotational axis 702 is present at the juncture of surface 524 and surface 530 of protrusion end face 500, adjacent to the juncture of upper recess contact surface 620 and surface 622 of recess end face 600. FIG. 8 demonstrates that coupling protrusion end face 500 with recess end face 600 by rotation about second axis 702 requires a smaller displacement of a portion of recess end face 600 of about 2.0 mm. As shown in FIG. 9, rotation about second axis 702 creates a contact surface of length L14 between protrusion guide surface 560 and recess boundary surface 680. From the position depicted in FIG. 9, where protrusion end face 500 is substantially parallel to recess end face 600, coupling of protrusion end face 500 with recess end face 600 can be completed by applying a force on upper surface 20 of floor panel 10 including protrusion end face 500, accomplishing a translation of protrusion 506 into recess 606, as described with reference FIGS. 3-5.

Figure 10:
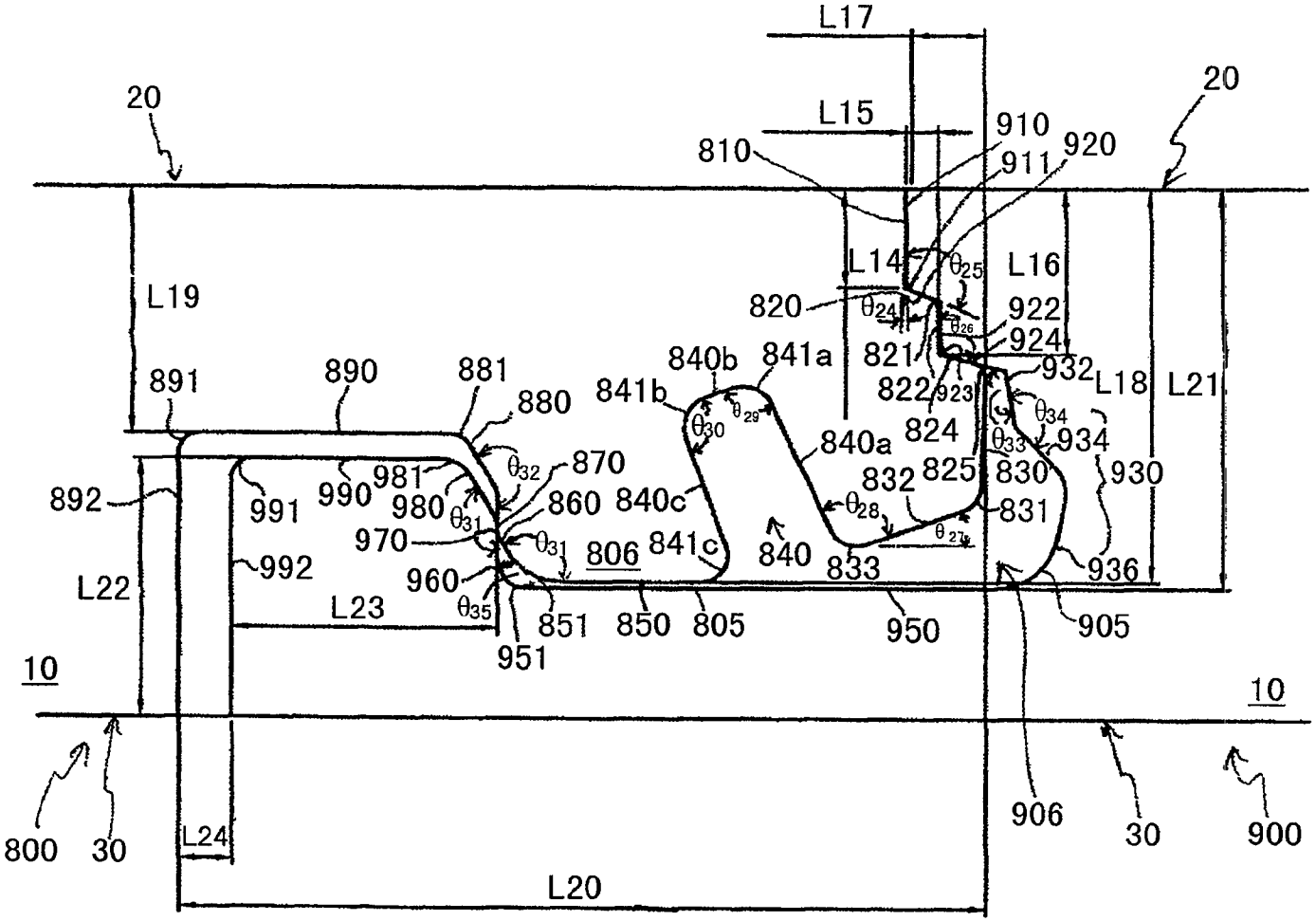
FIG. 10 is a fourth cross-sectional side view of the embodiment of FIG. 7 in partial engagement, showing that the protrusion is already installed in the recess.

Referring now to FIG. 10, a third exemplary preferred embodiment of a coupled protrusion end face 800 and recess end face 900 are depicted. Here, floor panel 10 has a thickness T4 As shown in FIG. 10, protrusion end face 800 is characterized by a periphery 805 formed between upper surface 20 and floor contact surface 30 in floor panel 10 including protrusion end face 800. Recess end face 900 is characterized by a periphery 905 formed between upper surface 20 and floor contact surface 30 in floor panel 10 including recess end face 900. The curve or protrusion periphery 805 and recess periphery 905 can include a sequence of planes, curved surfaces and features formed between upper surface 20 and floor contact surface 30.

Protrusion upper lip surface 810 and recess upper lip surface 910 are shown adjacent upper surface 20 and may be disposed at an angle θ24 of between about 0 degrees and about 3 degrees, preferably about 1 degree, with respect to one another. Surfaces 810, 910 can be planar and can extend from upper surface 20 a distance about 1.0 mm to about 3.0 mm, preferably about 1.5 mm. Surface 910 terminates in a sharp or arcuate transition 911.

Adjacent to the protrusion upper lip surface 810 is an upper protrusion first contact surface 820. As shown in FIG. 10, upper recess contact surface 920 is provided for example adjacent to surface 910 such that surface 920 are substantially coplanar and contiguous with surface 820 in coupled condition.

Upper protrusion first contact surface 820 may extend a depth of about 0.1 to about 1.0 mm and preferably about 0.5 mm from surface 810, and may include sharp or arcuate transition 821 adjacent to the next feature of periphery 805, which can be second protrusion upper lip surface 822. Surface 822 can be substantially perpendicular to the plane of upper surface 20 and/or floor contact surface 30. As shown in FIG. 10, surface 920 is adjacent to second recess upper lip surface 922. Surface 922 can be for example parallel to and configured to contact surface 822 when floor panels 10 are in a coupled condition. The second protrusion upper side surface 822 and the second recess upper lip surface 922 can extend between 0.1 mm and 1.0 mm, preferably 0.5 mm. Surface 922 can include a sharp or arcuate transition 923.

Adjacent to surface 822 is a second protrusion upper contact surface 824. The second protrusion upper contact surface 824 is generally parallel to the upper protrusion first contact surface 820 and can extend from the protrusion upper lip surface 810 about 0.5 mm to 1.5 mm, preferably about 1.2 mm. The second protrusion upper contact surface 824 can comprise a sharp or arcuate transition. As shown in FIG. 10, an upper second recess contact surface 924 can be for example adjacent to the second recess upper side surface 922. Surface 924 is substantially coplanar and contiguous with surface 824 in coupled condition.

Adjacent to surface 824 is protrusion leading surface 830. In the well installed state as shown in FIG. 10, along the protrusion preferably 805 and the recess preferably 905, no contact points are preferably provided in the segment from this point to the contact point between a lower third protrusion contact surface 870 and a lower third recess contact surface 970.

Along protrusion periphery 805, surface 830 is adjacent to second protrusion upper contact surface 824. Surface 830 can include sharp or arcuate transition 831 and a second planar portion 832. The second planar portion 832 of surface 830 can comprise a sharp or arcuate transition 833.

Adjacent to surface 830, back notch 840 can include three back notch surfaces: first back notch surface 840*a*, second back notch surface 840*b*, and third back notch surface 840*c*. First back notch surface 840*a* can begin with transition 833 and can include a sharp or arcuate transition 841*a*.

Adjacent to surface 840*a* second back notch surface 840*b* can extend about 0.5 mm to 1.5 mm, preferably about 1.0 mm. Second back notch surface 840*b* can include a sharp or arcuate transition 841*b*.

The third back notch surface 840*c* closely adjacent to the second back notch surface 840*b* can comprise a sharp or arcuate transition 841*c*.

Adjacent to arcuate transition 841*c* protrusion bottom surface 850 extends, for example, substantially parallel to the plane of upper surface 20 and/or floor contact surface 30. Protrusion bottom surface 850 can include a sharp or arcuate transition 851 adjacent to the next feature of protrusion periphery 805, which can be a protrusion guide surface 860. Protrusion guide surface 860 can be disposed at an angle θ31 of between about 90 degrees and about 150 degrees, preferably about 120 degrees, with respect to surface 850.

Adjacent to an end of protrusion guide surface 860 may be a lower protrusion contact surface 870, which for example can extend about 0.1 to about 1.0 mm and preferably about 0.3 mm. Lower protrusion contact surface 870 can be substantially perpendicular to the plane of upper surface 20 and/or floor contact surface 30. Adjacent to an end of surface 870 may be a protrusion boundary surface 880, which can be parallel to the plane of protrusion guide surface 860.

The protrusion boundary surface 880 terminates at a first protrusion transition surface 890. Surface 890 can be substantially parallel to upper surface 20 and/or floor contact surface 30. Surface 890 can include a sharp or arcuate transition 891. A second protrusion nesting surface 892 extends from the first protrusion nesting surface 890 to the floor contact surface 30 and is substantially perpendicular to the upper surface 20 and/or the floor contact surface 30.

Thus, a protrusion 806 is defined by periphery 805 between upper surface 20 and floor contact surface 30, and can begin with the protrusion upper lip surface 810 perpendicular to the upper surface 20.

As discussed above, second recess upper contact surface 924 extends beyond second protrusion upper contact surface 824 in coupled condition, as shown in FIG. 10. Adjacent to surface 924 is a curve 930 which can comprise a first planar portion 932. Adjacent to first planar portion 932, second planar portion 934 may be disposed at an angle θ34 between about 90 degrees and about 160 degrees, preferably about 140 degrees, from first planar portion 932. Curve 930 can also include a curvilinear portion 936 adjacent to an end of second planar portion 934, which may include multiple planar and curved surfaces as required.

As shown in FIG. 10, adjacent to curve 930, recess bottom surface 950 may be disposed substantially parallel to upper surface 20 and/or floor contact surface 30. Recess bottom surface 950 can include a sharp or arcuate transition 951 adjacent to the next feature of recess periphery 905, which can be a recess boundary surface 960. Recess bottom surface 950 and recess boundary surface 960 may be disposed at an angle θ35 of between about 90 degrees and about 150 degrees, preferably about 120 degrees, with respect to one another.

Adjacent to recess boundary surface 960, lower recess contact surface 970 extends about 0.1 to about 1.0 mm in length, preferably about 0.3 mm. Surface 970 can be substantially perpendicular to the plane of upper surface 20 and/or floor contact surface 30. Adjacent to surface 970 is recess guide surface 980 which can be generally parallel to the recess boundary surface 960. Surface 980 includes a sharp or arcuate transition 981.

Adjacent to surface 980, first recess nesting surface 990 can be substantially parallel to the plane of upper surface 20 and/or floor contact surface 30 and include a sharp or arcuate transition 991. Adjacent to surface 990, second recess nesting surface 992 extends from the surface 990 to the floor contact surface 30 and can be substantially perpendicular to the upper surface 20 and/or the floor contact surface 30.

Therefore, a recess 906 is defined by a recess periphery 905 between the upper surface 20 and the floor contact surface 30 and can extend to a vertical surface which is tangential to the recess end face surface 930 and substantially perpendicular to the upper surface 20 and/or the floor contact surface 30. Recess periphery 905 includes features that cooperate with features included in protrusion periphery 805 described above.

Figure 11:
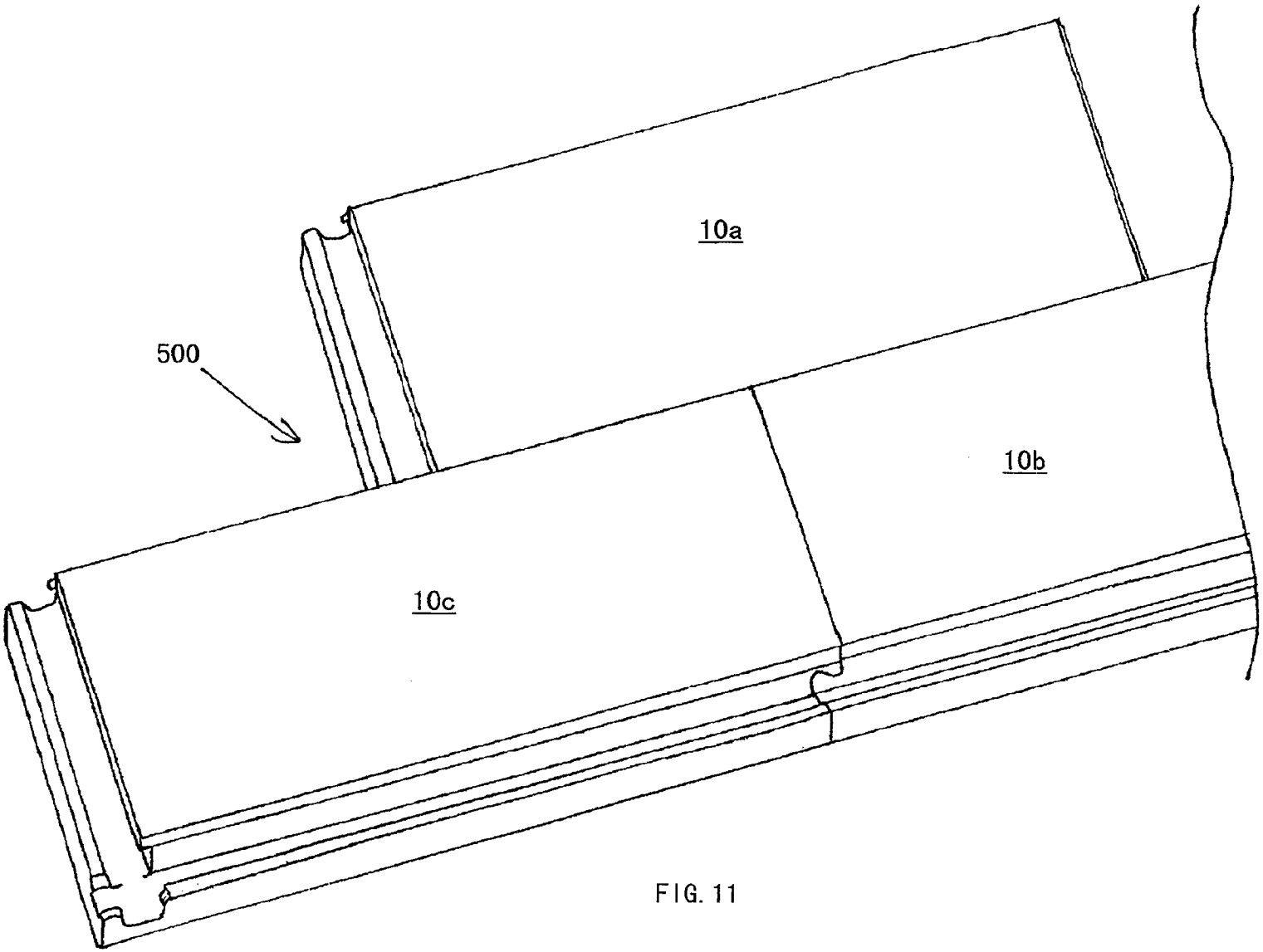
FIG. 11 is a partial perspective view of the flooring system.

FIG. 11 depicts an installation of three identical floor panels 10*a*, 10*b*, and 10*c*. Floor panel 10*a* and 10*b* are shown coupled as described above. Floor panel 10*c* is then installed by positioning each of its two protrusion end faces adjacent a corresponding recess end face of the other two panels. Floor panel 10*c* can be coupled by applying a force to the protrusion end faces to translate the protrusion end faces into each recess end face simultaneously. A flooring system 500 covering the floor of an area is formed in this manner.

Figure 12:
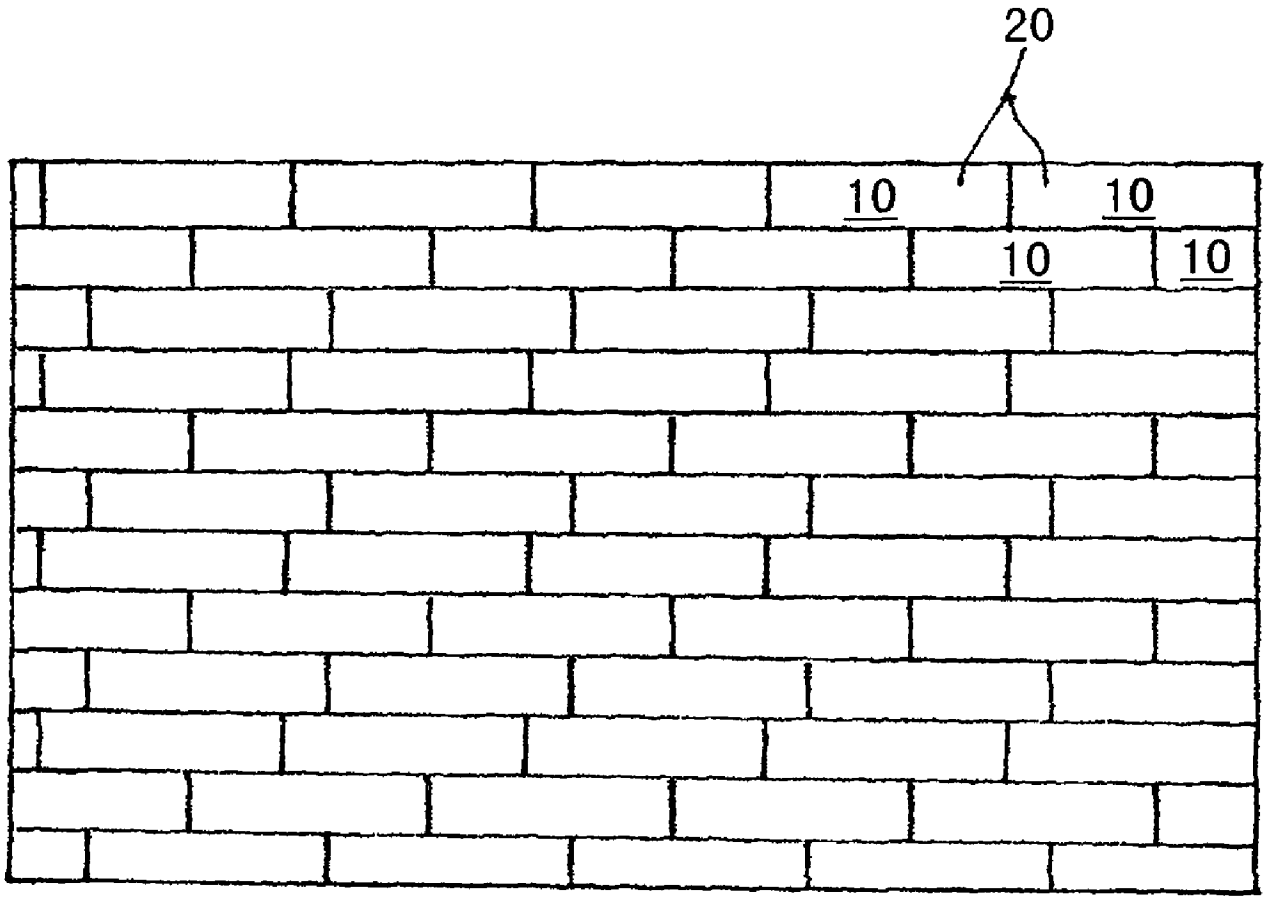
FIG. 12 is a top view of the flooring system of FIG. 11.

FIG. 12 shows a flooring system 500 installed to cover an entire rectangular floor area. In this view, the upper surface 20 of each panel is shown. In order to precisely cover an area of a given size and shape, certain floor panels 10 can be cut as required before installation.

Figure 13:
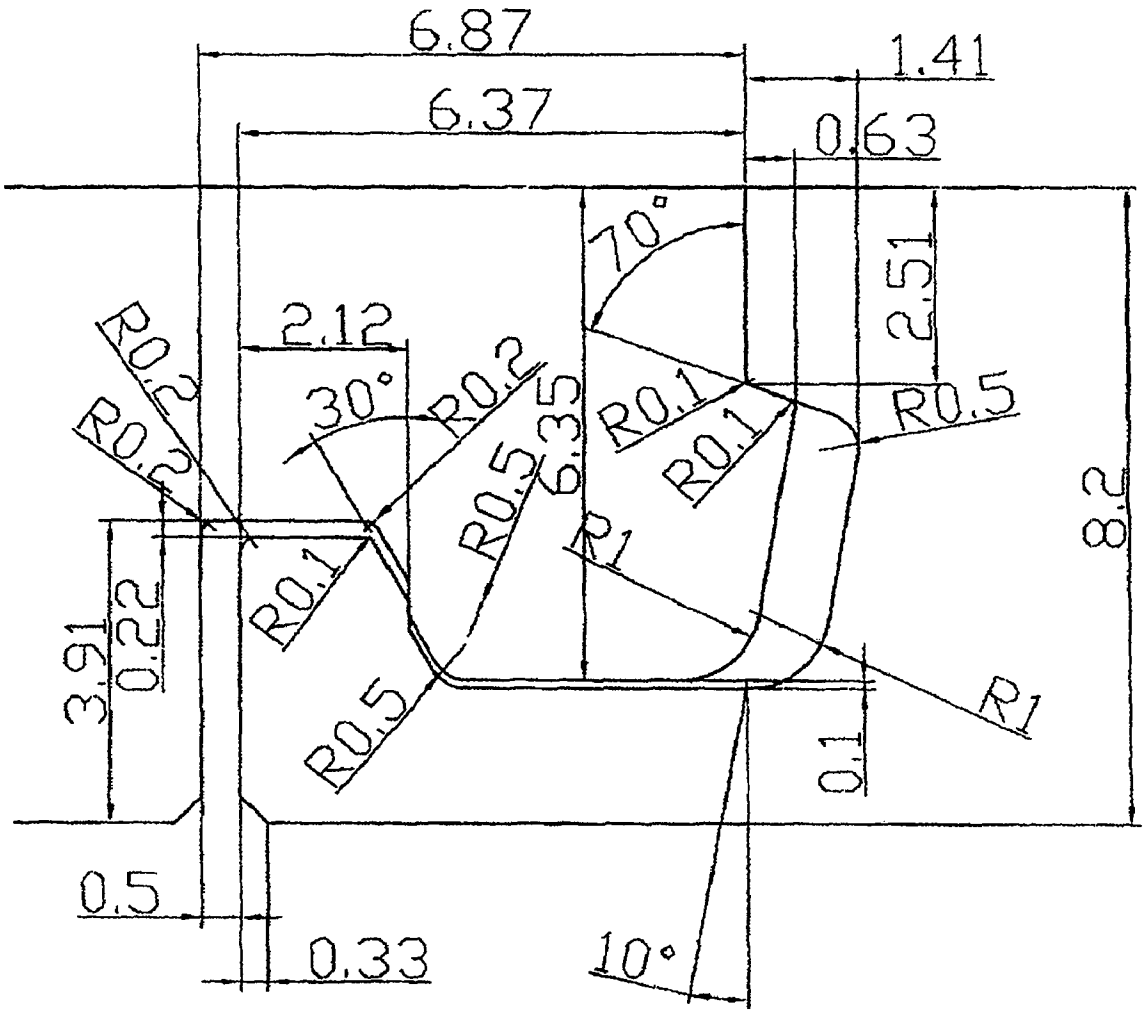
FIGS. 13-26 are cross-sectional side views of additional exemplary embodiments of a protrusion end face and a recess end face coupled to one another.
Figure 14:
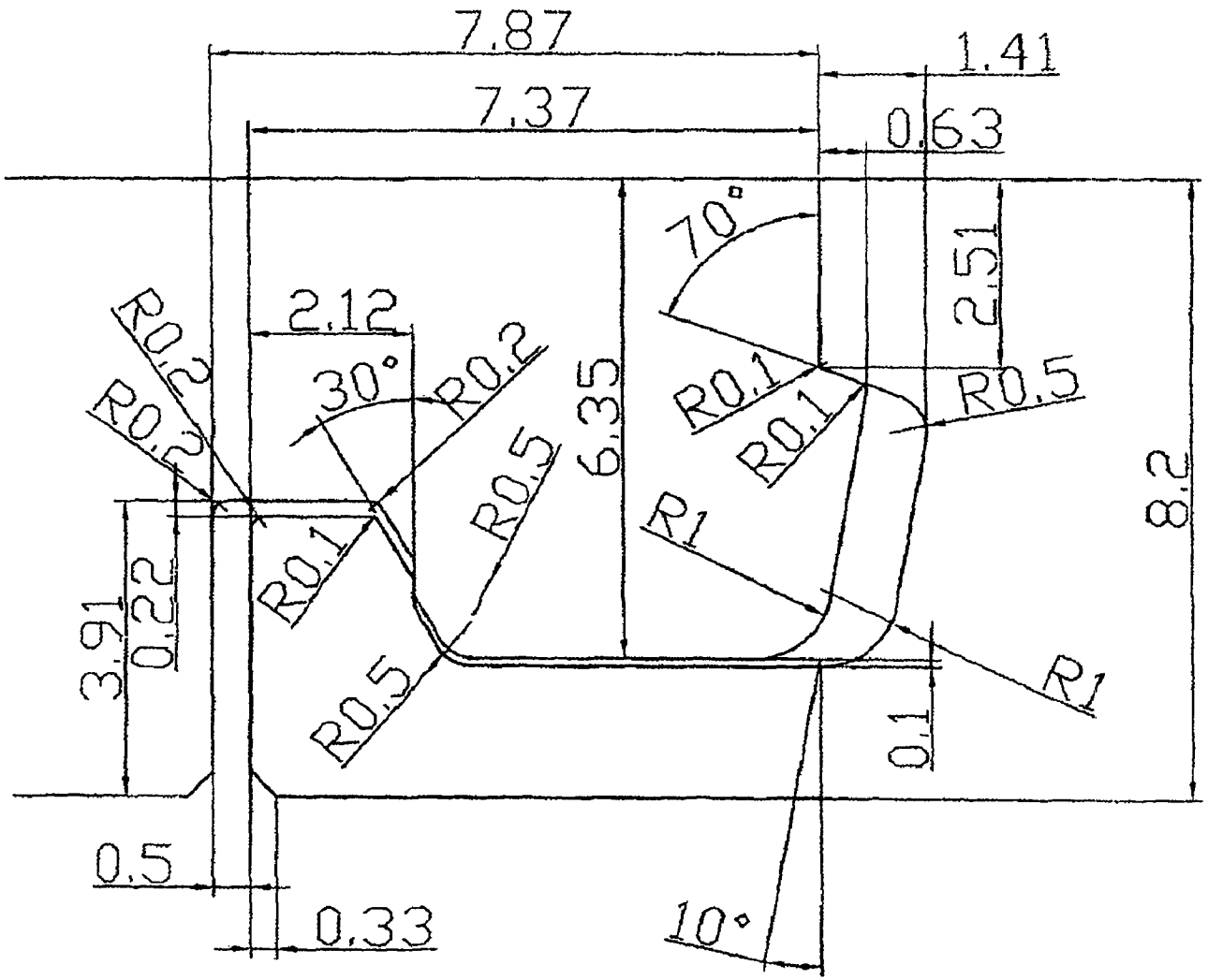
Figure 15:
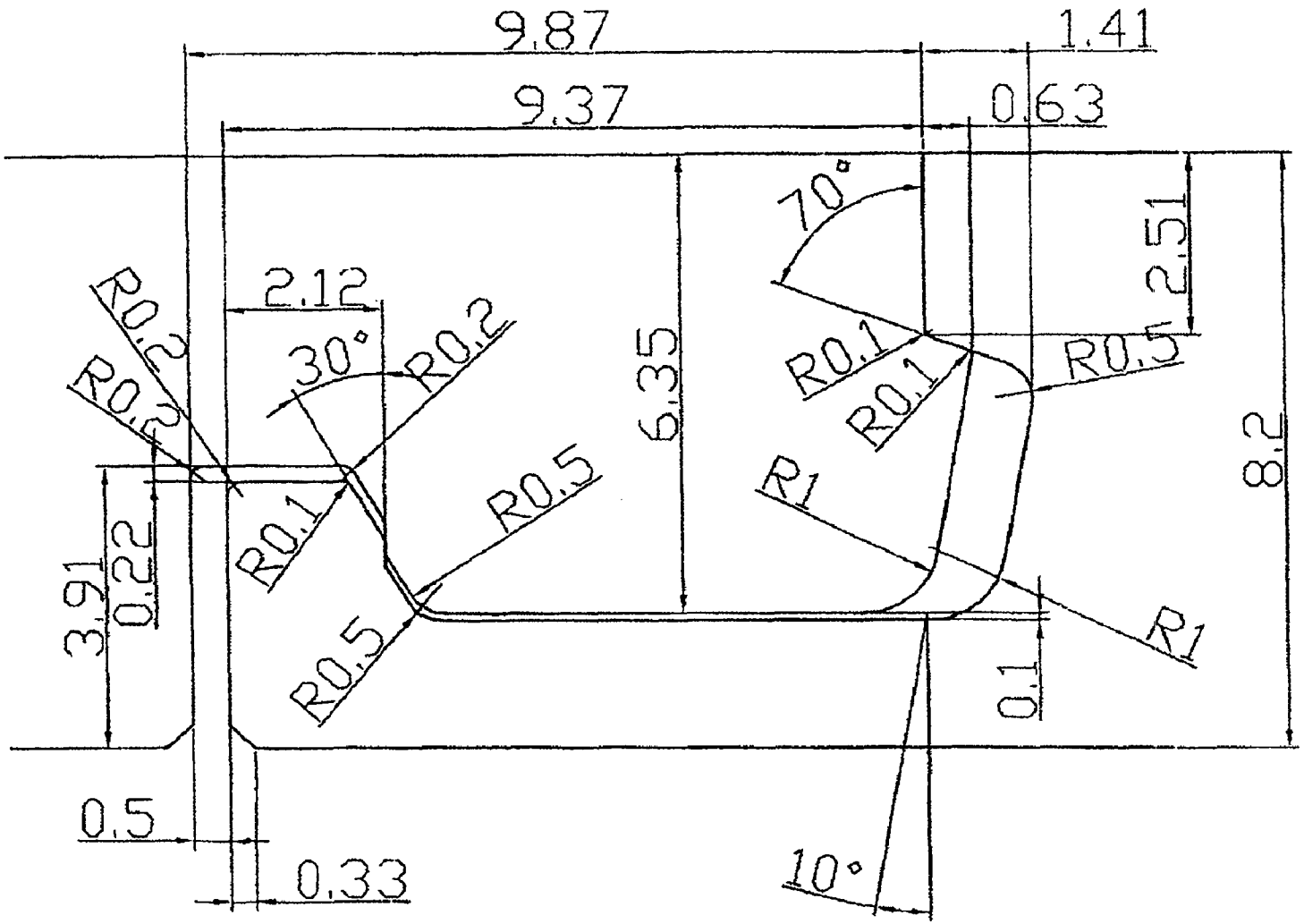
Figure 16:
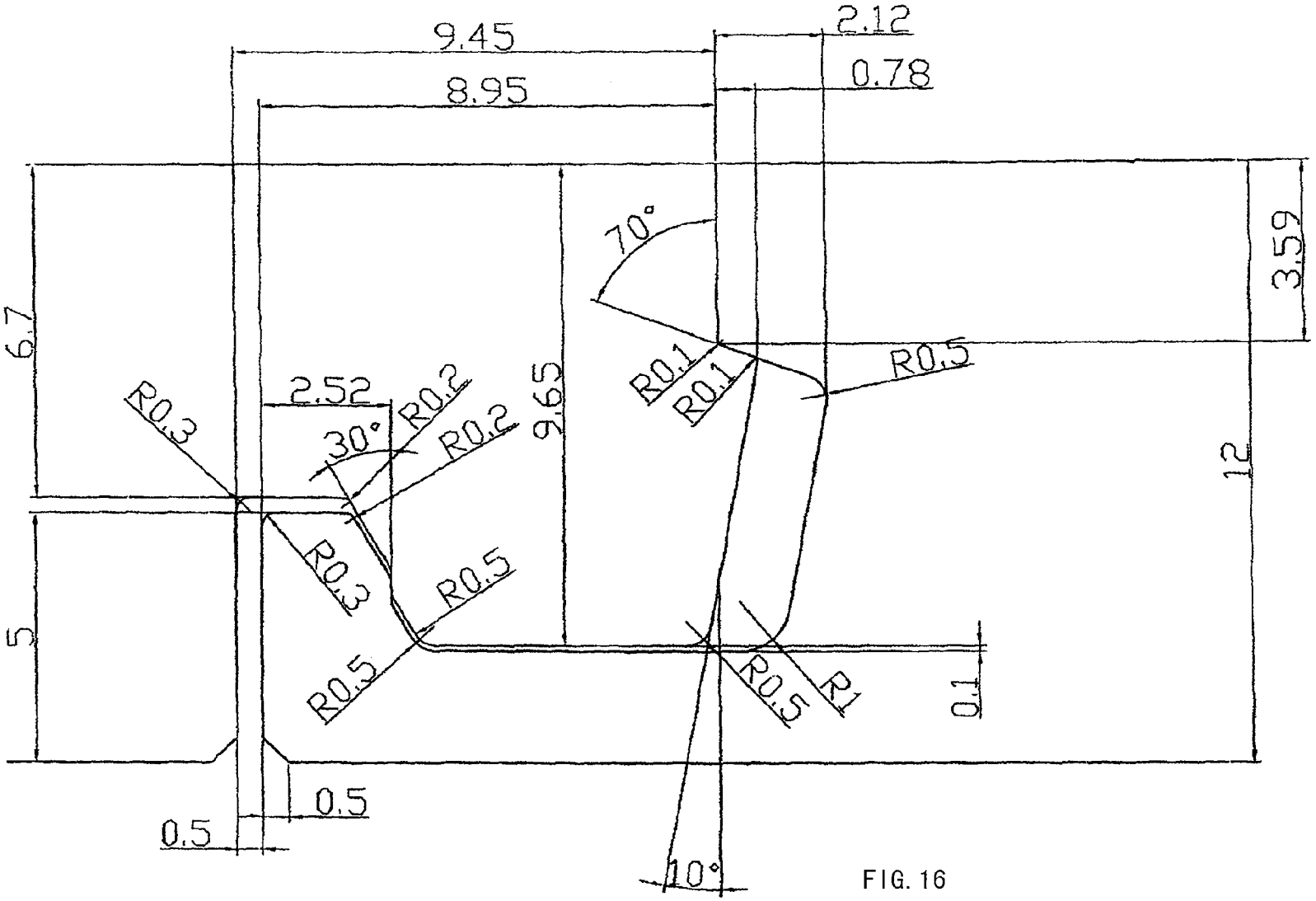
Figure 17:
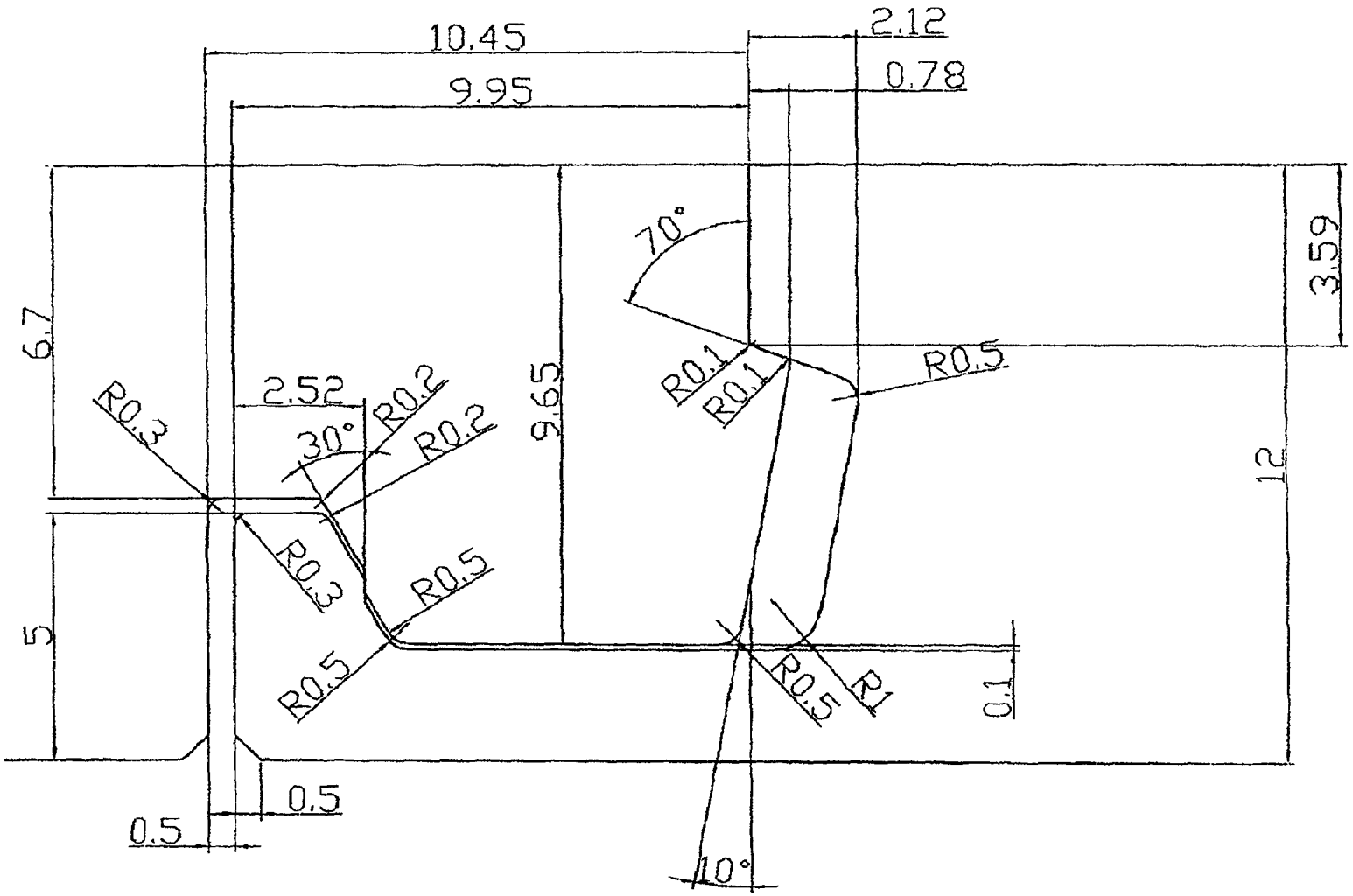
Figure 18:
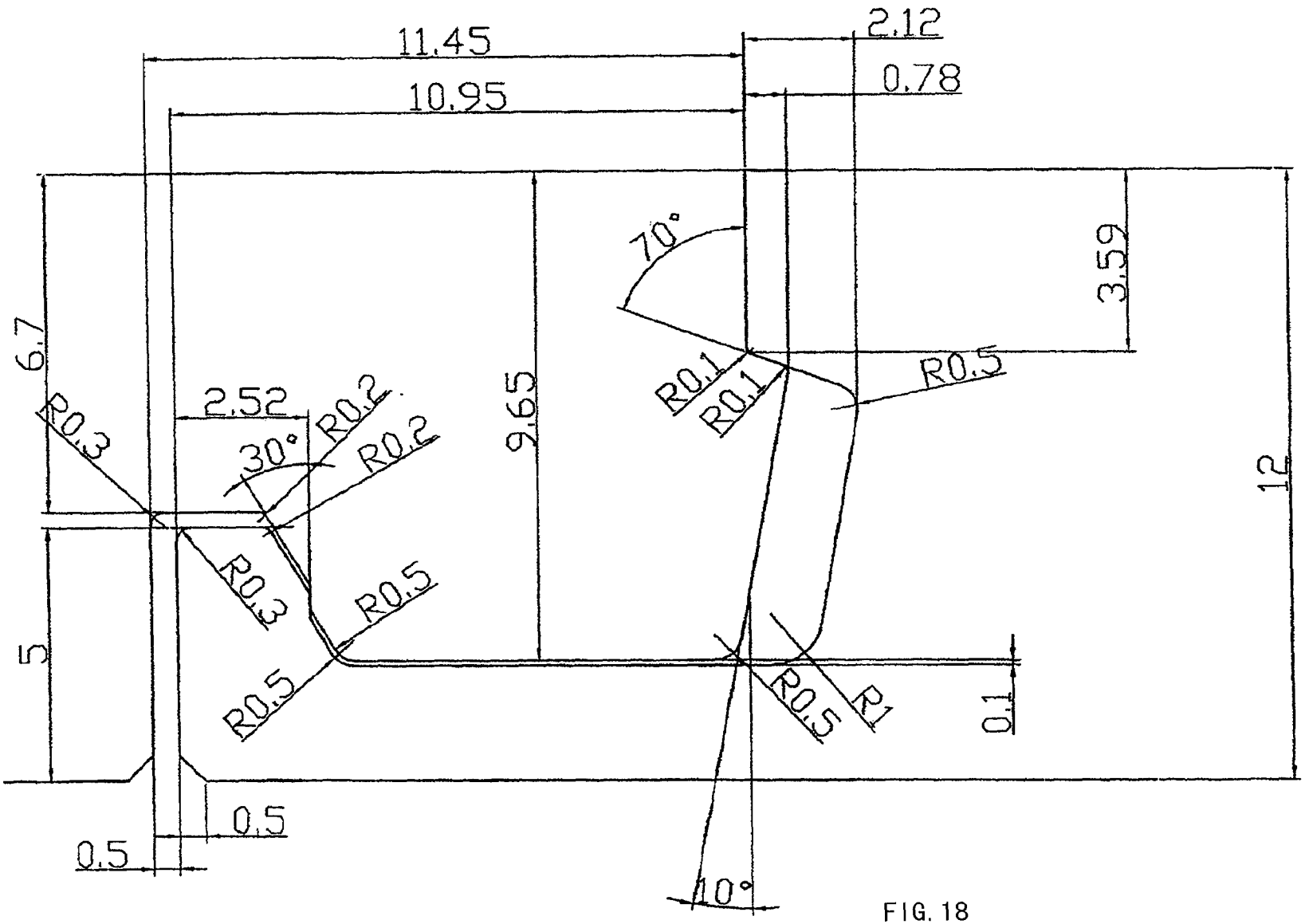
Figure 19:
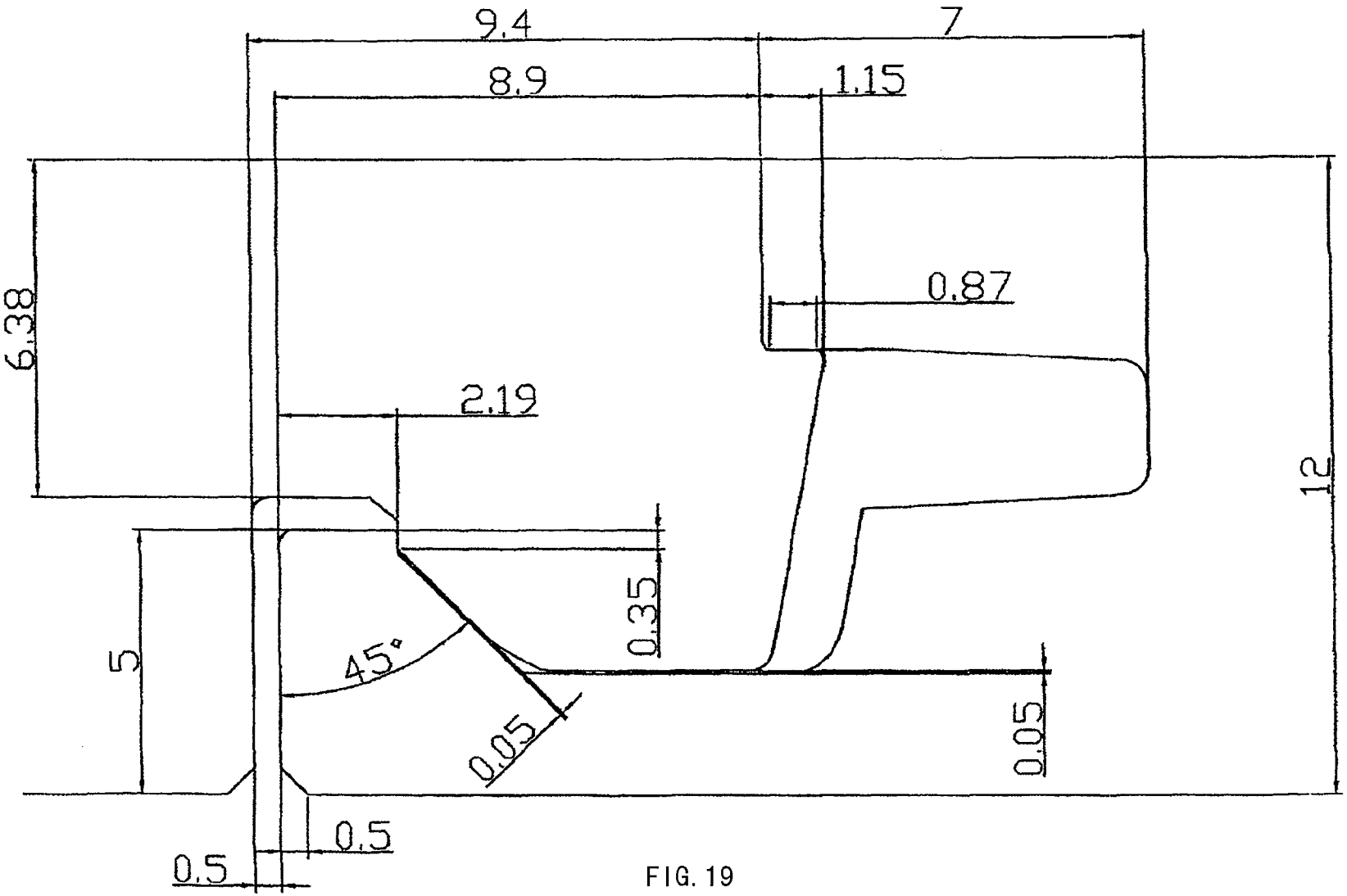
Figure 20:
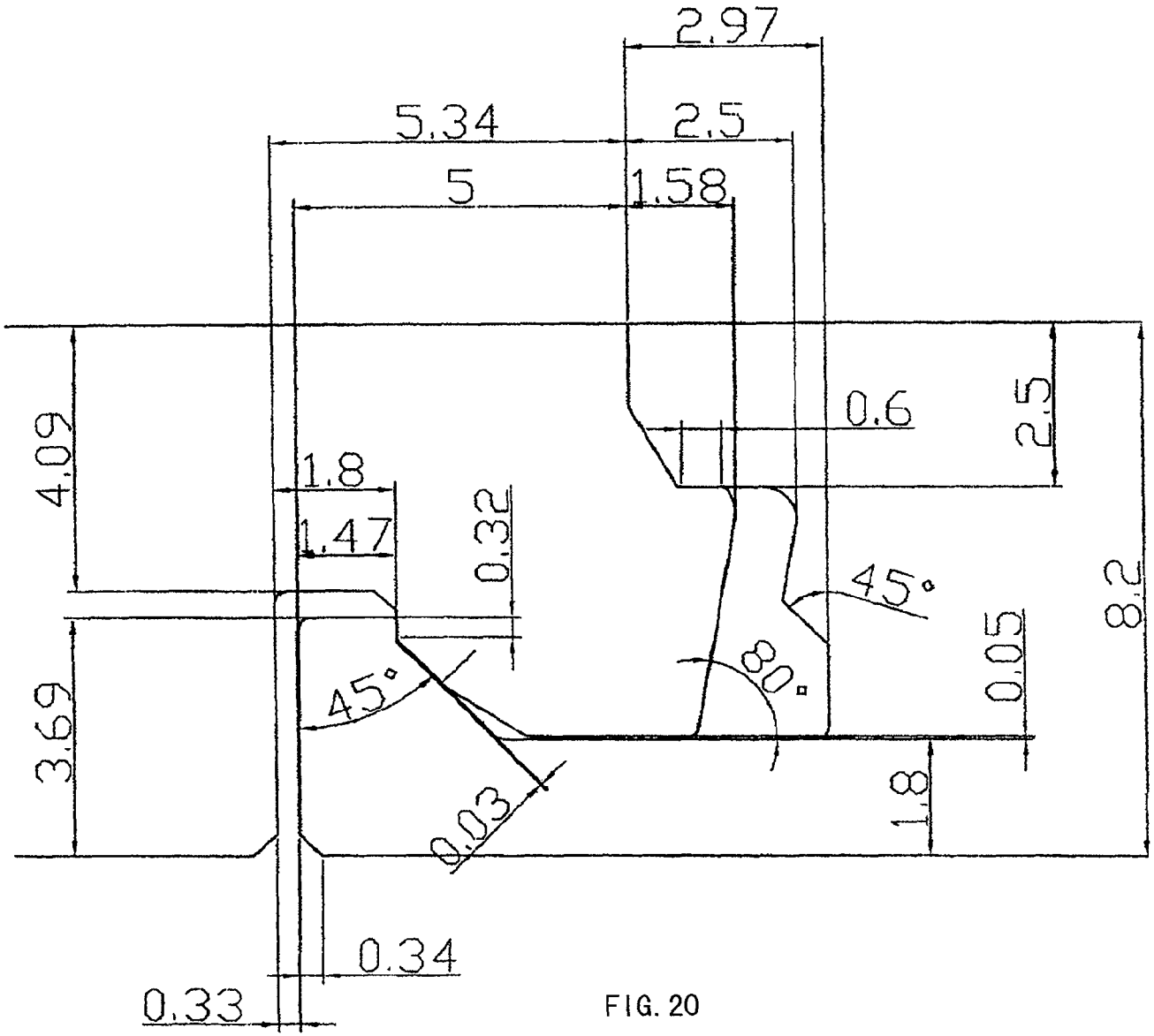
Figure 21:
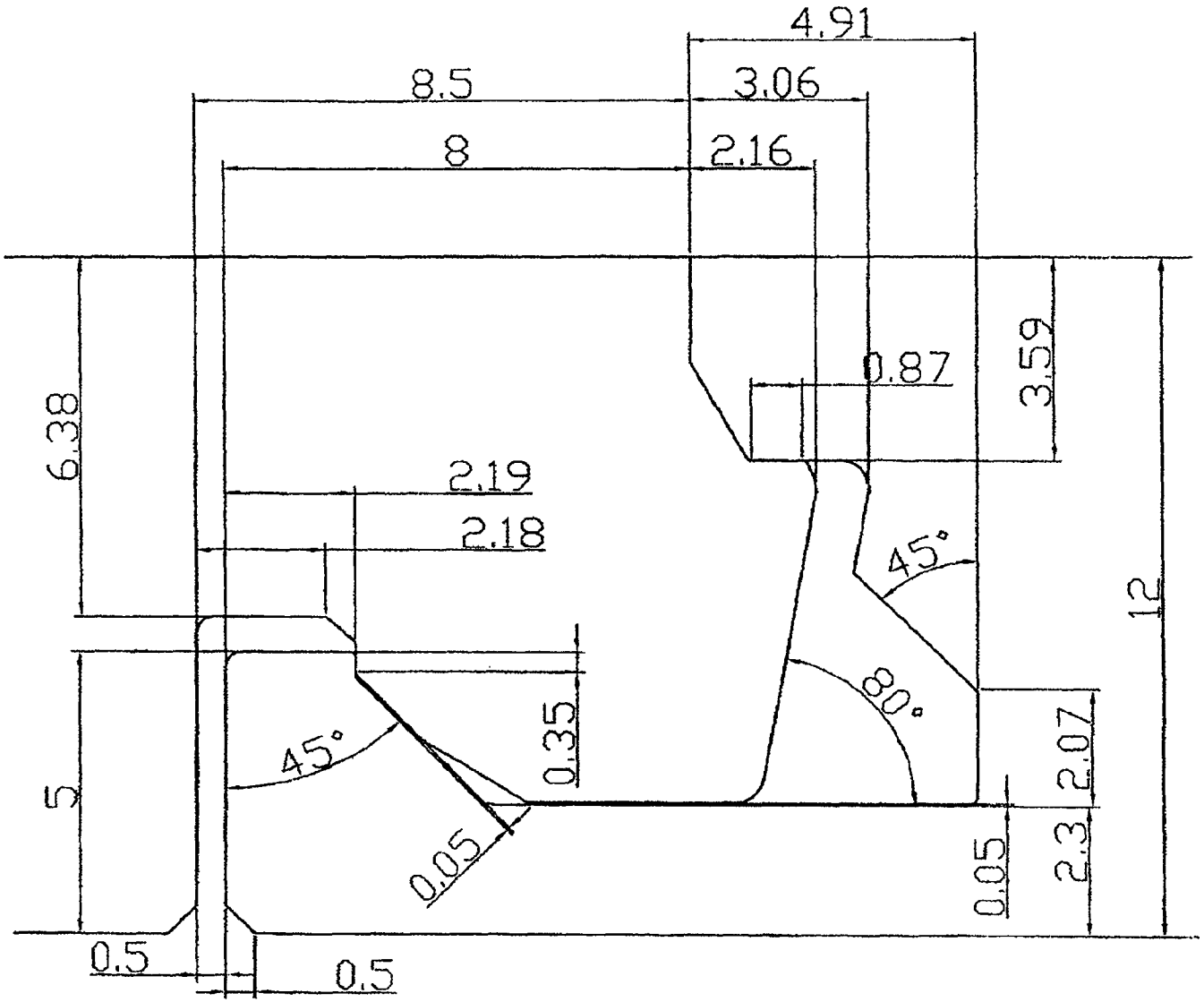
Figure 22:
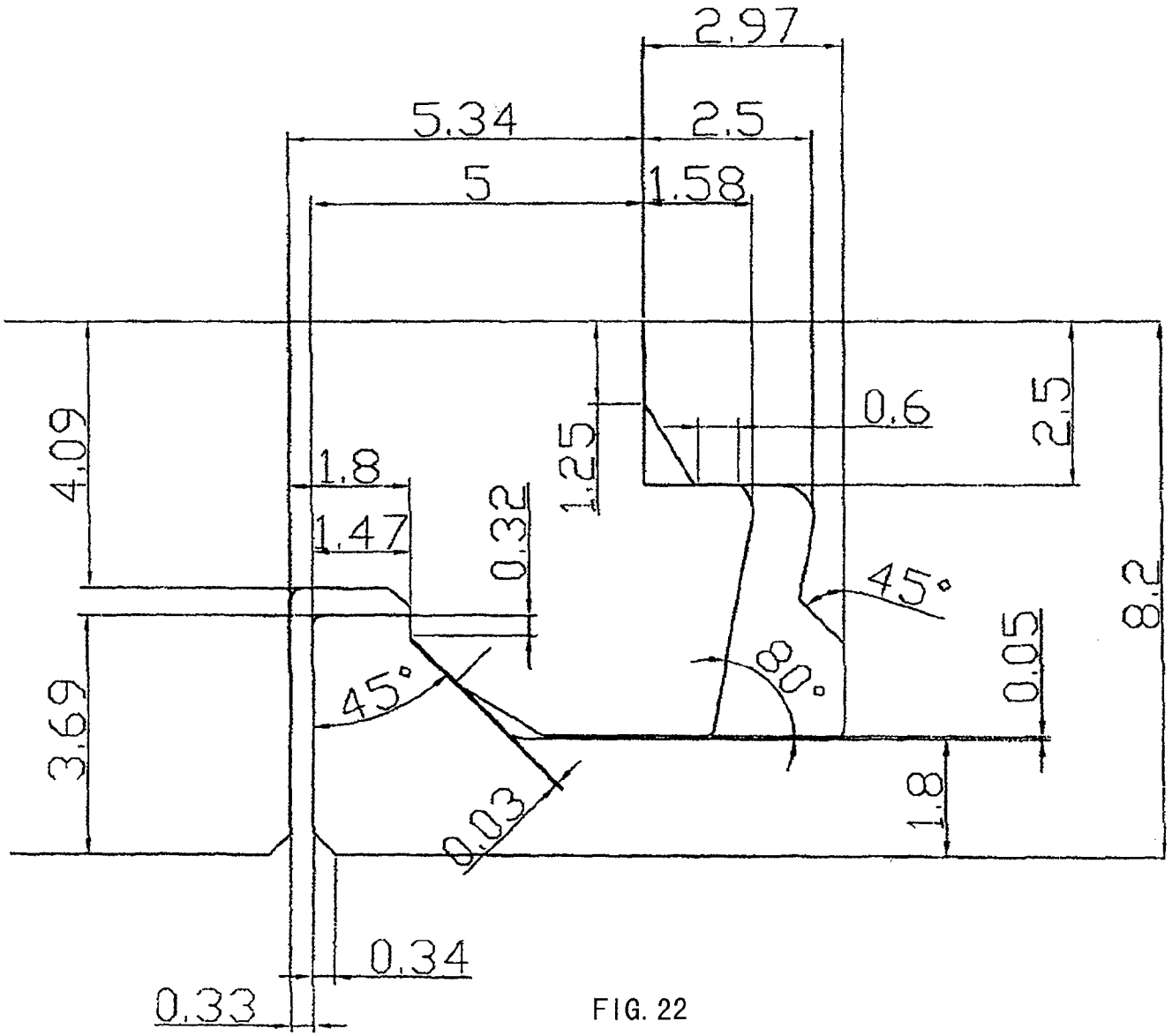
Figure 23:
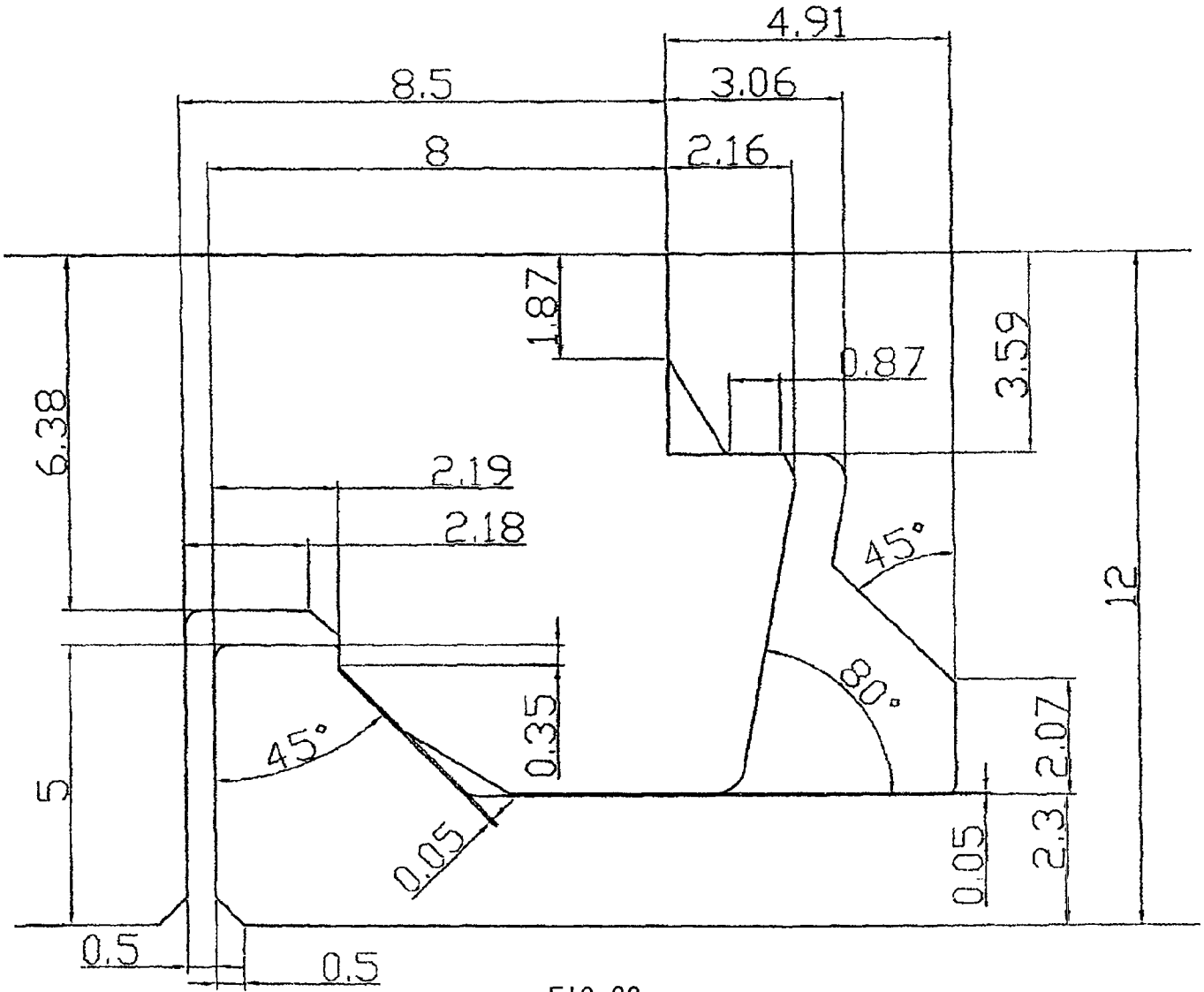
Figure 24:
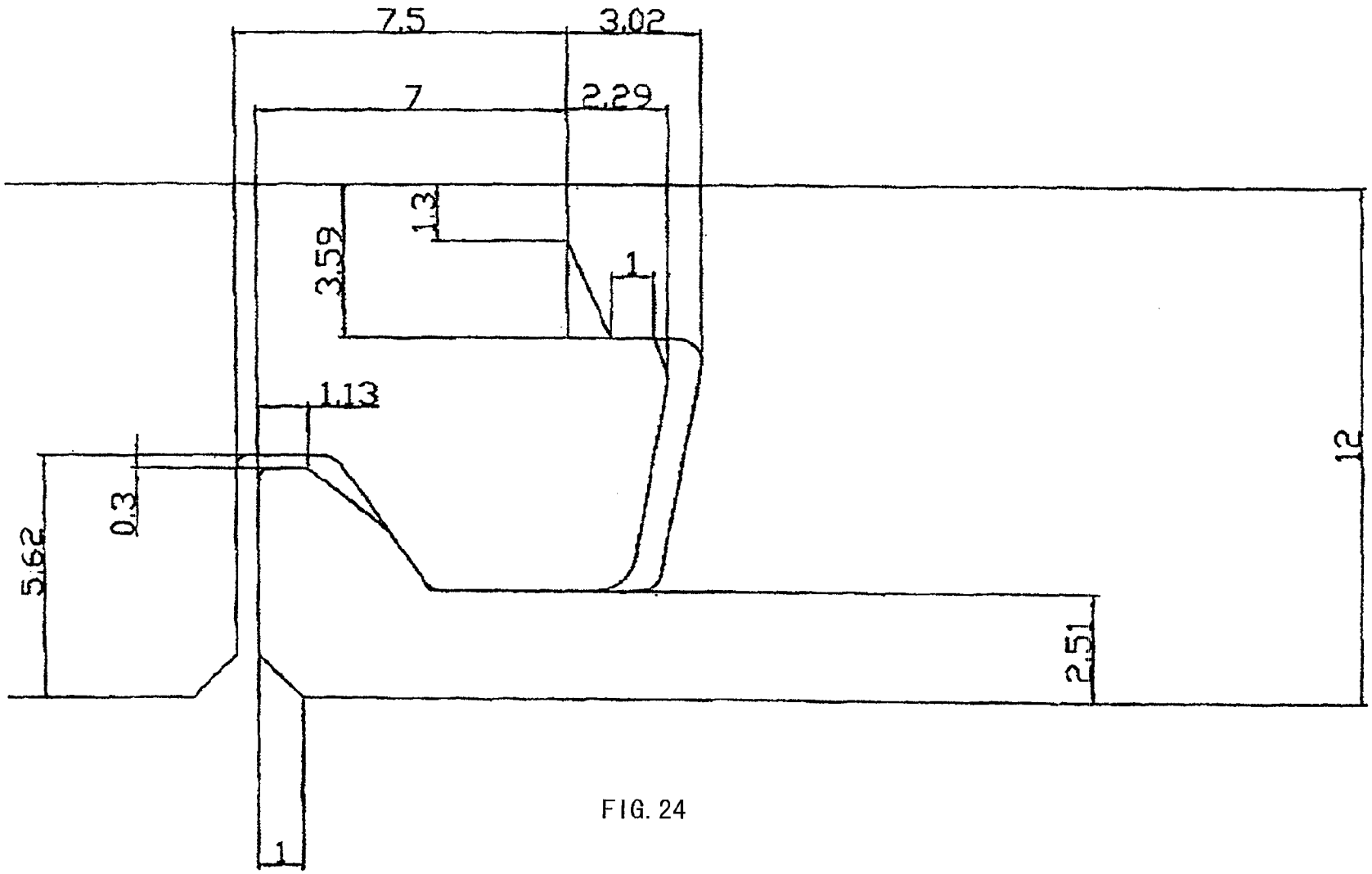
Figure 25:
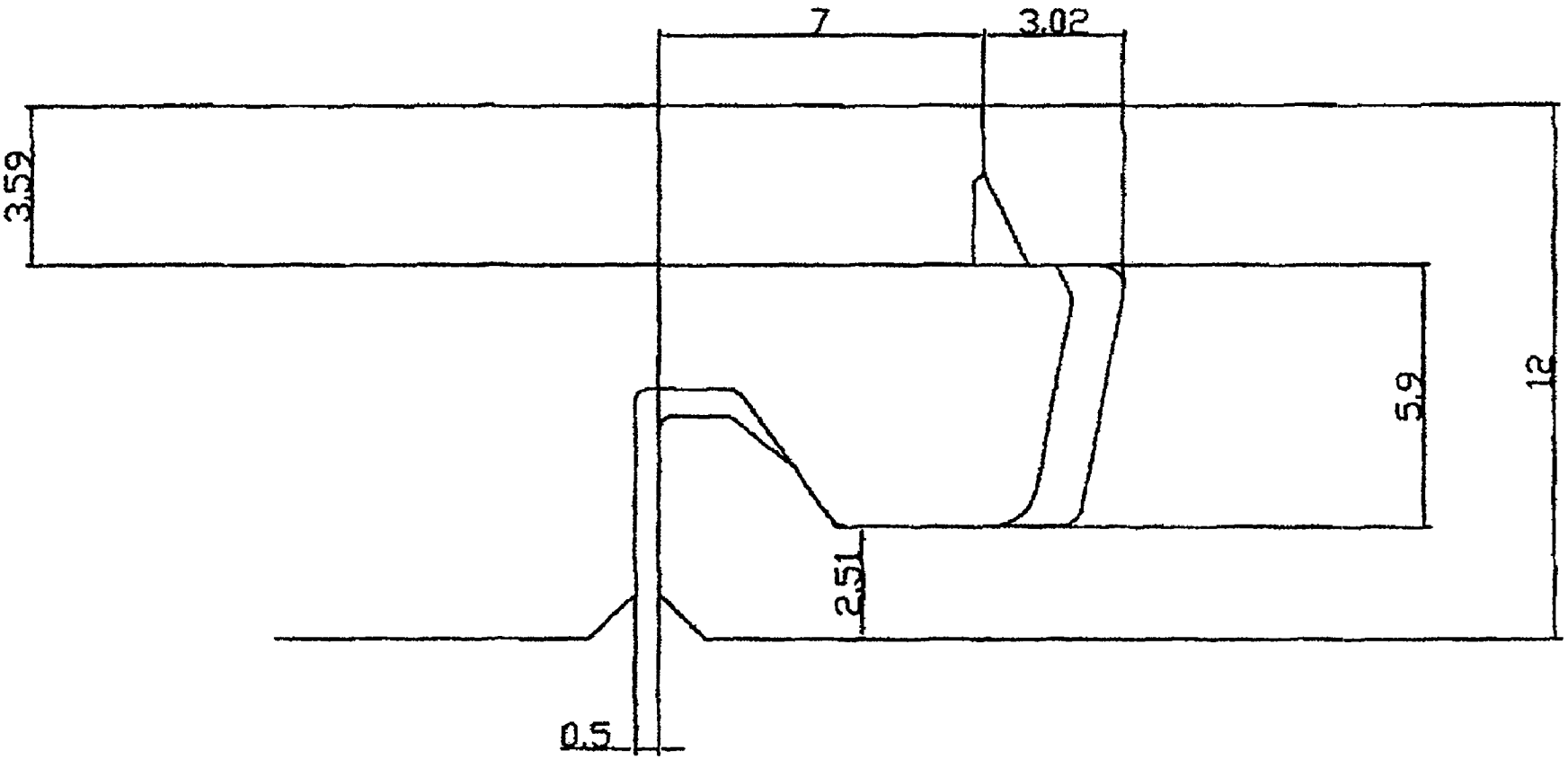
Figure 26:
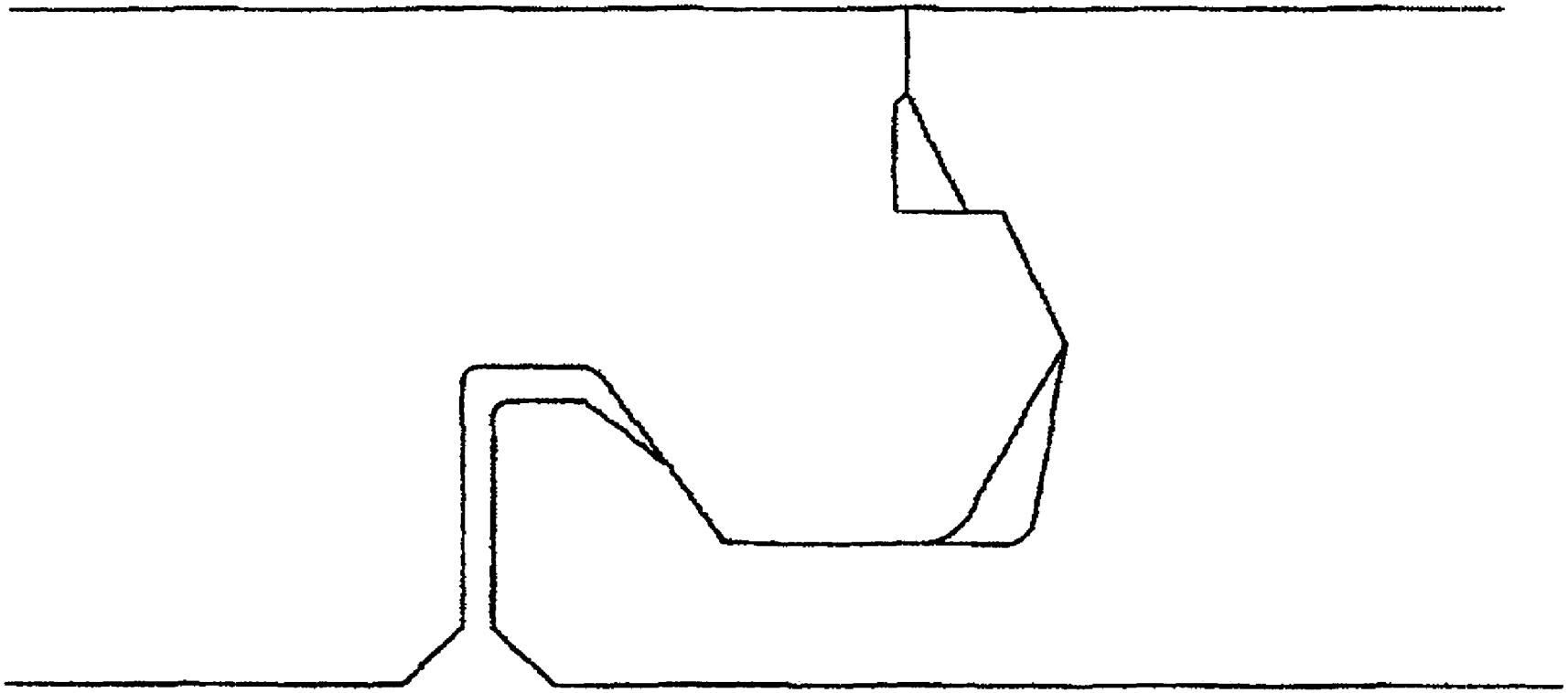

FIGS. 13-26 depict alternate embodiments of the present invention having alternate dimensions and configurations. For example, FIG. 13 depicts an alternate embodiment of a protrusion 106 that does not include a back notch.

While various descriptions of the present invention are described above, it should be understood that the various features can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. For example, it should also be apparent that the specific dimensions of a protrusion end face and a recess end face, including a protrusion and a recess, can vary based on factors such as the material and thickness of panels. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

The invention claimed is:

1. A method for assembling a first floor panel and a second floor panel which are adjacent to each other, the first and second floor panels comprising a floor panel snap-fitting structure, the method comprising:

positioning a lower step of said first floor panel in an upper groove of said second floor panel and contacting the lower step with the upper groove, wherein the first floor panel is angled to the second floor panel, wherein the lower step and an upper step are formed on a protrusion docking surface of the first floor panel with the lower step extending beyond the upper step in a horizontal direction, and wherein the upper groove and a lower groove are formed on a recess docking surface of the second floor panel with the upper groove extending beyond the lower groove in a horizontal direction;

rotating the first floor panel about a contact portion of the lower step of the first floor panel and the upper groove of the second floor panel as an axle so that said first floor panel is substantially parallel to the second floor panel;

applying a force to the first floor panel in a vertical direction to allow the first floor panel and the second floor panel to enter an assembled state, wherein in the assembled state the upper step and the lower step of the first floor panel are respectively accommodated in the upper groove and the lower groove of the second floor panel, and wherein in the assembled state the protrusion docking surface of the first floor panel at least partially contacts the recess docking surface of the second floor panel.

2. The method according to claim 1, wherein an upper surface of said upper step is substantially parallel to an upper surface of said upper groove.

3. The method according to claim 2, wherein the upper surface of said upper step and said upper surface of said upper groove are at an angle ($\theta_{12}$) relative to a horizontal plane.

4. The method according to claim 1, wherein a side surface of said upper step is substantially parallel to a side surface of said upper groove.

5. The method according to claim 1, wherein an upper surface of said lower step is substantially parallel to an upper surface of said lower groove.

6. The method according to claim 5, wherein the upper surface of said lower step and the upper surface of said lower groove are at an angle ($\theta_{13}$) relative to a horizontal plane.

7. A floor panel, comprising:

(1) an upper surface;

(2) a floor contact surface;

(3) at least one recess end face including:

an upper lip adjacent to the upper surface;

a lower lip; and a recess including an upper recess first contact surface, at least one lower recess contact surface and a recess guide surface;

(4) at least one protrusion end face opposite to the recess end face, the protrusion end face comprising:

a protrusion first upper side surface adjacent to the upper surface; and a protrusion comprising an upper protrusion first contact surface, at least one lower protrusion contact surface and a protrusion guide surface, wherein the protrusion end face and the recess end face of an identical one of the panel are configured and dimensioned to be coupled by positioning the protrusion on the lower recess lip of the identical one of the panel and applying a compression force in a direction substantially perpendicular to a plane of the upper surface which causes the protrusion guide surface to contact the recess guide surface and translates the protrusion into the recess; and wherein, when the protrusion end face and the recess end face of the identical one of the panel are coupled, the upper protrusion first contact surface engages the upper recess first contact surface to prevent decoupling of the panel and the identical one of the panel in the direction perpendicular to the plane of the upper surface, and the lower protrusion contact surface engages the lower recess contact surface to prevent decoupling of the panel and the identical one of the panel in a direction perpendicular to the protrusion end face.

8. The floor panel according to claim 7, wherein the protrusion substantially extends along the entire length of the protrusion end face.

9. The floor panel according to claim 7, wherein the recess substantially extends along the entire length of the recess end face.

10. A floor panel snap-fitting structure for assembling a first floor panel and a second floor panel which are adjacent to each other, the floor panel snap-fitting structure comprising:

a protrusion end face formed on the first floor panel and defining a protrusion; and a recess end face formed on the second floor panel and defining a recess for accommodating at least part of the protrusion;

wherein the protrusion and the recess are configured to allow at least part of the protrusion to be pressed into the recess in a vertical direction during assembling, thereby assembling the first floor panel together with the second floor panel, the vertical direction being substantially perpendicular to a plane where the first and second floor panels lie;

wherein said protrusion end face comprises a protrusion docking surface, said recess end face comprises a recess docking surface, and wherein on completion of the assembling, said protrusion docking surface at least partially contacts said recess docking surface;

wherein an upper step and a lower step are formed in the protrusion docking surface, the lower step extending beyond the upper step in a horizontal direction; an upper groove and a lower groove are formed in the recess docking surface, the upper groove extending beyond the lower groove in a horizontal direction; and wherein during assembly of the first floor panel and the second floor panel, the upper groove first accommodates the lower step to allow the first and second floor panels to be positioned in a positioned state and then in an assembled state after completion of the assembly, the upper step and the lower step are respectively received in the upper groove and the lower groove.

11. The floor panel according to claim 7, wherein said floor panel has a back notch in a lower surface of the protrusion thereof to introduce elasticity to said protrusion.

12. A flooring system comprising:

a first floor panel and a second floor panel, wherein the first floor panel comprises:

(1) an upper surface;

(2) a floor contact surface;

(3) at least one recess end face including:

an upper lip adjacent to the upper surface, the upper lip being provided with a recess first upper lip surface adjacent to the upper surface and the recess first upper lip surface being perpendicular to a plane of the upper surface of the first floor panel;

a lower lip; and a recess including an upper recess first contact surface and at least one lower recess contact surface and a recess guide surface;

wherein the second floor panel comprises:

(1) an upper surface;

(2) a floor contact surface;

(3) at least one protrusion end face including:

a protrusion first upper side surface adjacent to the upper surface, the protrusion first upper side surface being perpendicular to a plane of the upper surface of the second floor panel; and a protrusion comprising an upper protrusion first contact surface, at least one lower protrusion contact surface and a protrusion guide surface, wherein, the protrusion end face of the second floor panel and the recess end face of the first floor panel are configured and dimensioned to be coupled by positioning the protrusion on the lower recess lip and applying a compression force in a direction substantially perpendicular to the plane of the upper surface which causes the protrusion guide surface to contact the recess guide surface and translates the protrusion into the recess; and wherein, when the protrusion end face of the second floor panel and the recess end face of the first floor panel are coupled, the upper protrusion first contact surface engages the upper recess first contact surface to prevent decoupling of the first floor panel and the second floor panel in a direction perpendicular to the plane of the upper surface, and the lower protrusion contact surface engages the lower recess contact surface to prevent decoupling of the first floor panel and the second floor panel in a direction perpendicular to the protrusion end face.

13. The flooring system according to claim 12, wherein when the protrusion end face of the second floor panel and the recess end face of the first floor panel are coupled, a clearance is formed between the protrusion and the lower lip.

14. The flooring system according to claim 12, wherein the lower protrusion contact surface and the lower recess contact surface are inclined at 90 degree angle relative to the upper surface.

15. The flooring system according to claim 12, wherein for said first floor panel, a recess second upper lip surface is provided at an outer end of the upper recess first contact surface and joined to an upper recess second contact surface, wherein the recess first upper lip surface is parallel to the recess second upper lip surface; the upper recess first contact surface is parallel to the upper recess second contact surface, and for said second floor panel, a protrusion second upper side surface is provided at an outer end of the upper protrusion first contact surface and joined to the upper protrusion second contact surface, wherein the protrusion first upper side surface is parallel to the protrusion second upper side surface, and the upper protrusion first contact surface is parallel to the upper protrusion second contact surface.

16. The floor panel according to claim 7, wherein the upper lip is provided with a recess first upper lip surface adjacent to the upper surface.

17. The floor panel according to claim 16, wherein the protrusion extends outward over the upper surface.

18. The floor panel according to claim 16, wherein the recess first upper lip surface is substantially perpendicular to the plane of the upper surface, and the protrusion first upper side surface is substantially perpendicular to the plane of the upper surface.

19. The floor panel according to claim 18, wherein the recess first upper lip surface abuts closely against the protrusion first upper side surface when the protrusion end face and the recess end face have been coupled.

20. The floor panel of claim 16, wherein the recess first upper lip surface is adjacent to the upper recess first contact surface.

21. The floor panel according to claim 20, wherein the recess first upper lip surface is a plane.

22. The floor pane of claim 7, wherein the protrusion first upper side surface is adjacent to the upper protrusion first contact surface.

23. The floor panel according to claim 22, wherein the protrusion first upper side surface is a plane.

24. The floor panel according to claim 22, wherein the upper protrusion first contact surface extends outward from the protrusion first upper side surface.

25. The floor panel according to claim 11, wherein the upper protrusion first contact surface is arranged at a vertical position higher than the back notch.

26. The floor panel according to claim 17, wherein for said floor panel, a recess second upper lip surface is provided at an outer end of the upper recess first contact surface and joined to an upper recess second contact surface, wherein the recess first upper lip surface is parallel to the recess second upper lip surface; the upper recess first contact surface is parallel to the upper recess second contact surface, and for a second floor panel with at least one protrusion end face adaptable to be coupled with the at least one recess end face of said floor panel, a protrusion second upper side surface is provided at an outer end of the upper protrusion first contact surface and joined to the upper protrusion second contact surface, wherein the protrusion first upper side surface is parallel to the protrusion second upper side surface, and the upper protrusion first contact surface is parallel to the upper protrusion second contact surface.

27. The floor panel snap-fitting structure according to claim 26, wherein an upper surface of said upper step is substantially parallel to an upper surface of said upper groove.

28. The floor panel snap-fitting structure according to claim 27, wherein the upper surface of said upper step and said upper surface of said upper groove are at an angle ($\theta_{12}$) relative to a horizontal plane.

29. The floor panel snap-fitting structure according to claim 26, wherein a side surface of said upper step is substantially parallel to a side surface of said upper groove.

30. The floor panel snap-fitting structure according to claim 26, wherein an upper surface of said lower step is substantially parallel to an upper surface of said lower groove.

31. The floor panel snap-fitting structure according to claim 30, wherein the upper surface of said lower step and the upper surface of said lower groove are at an angle ($\theta_{13}$) relative to a horizontal plane.

32. The floor panel snap-fitting structure according to claim 26, wherein in the positioned state of the floor panel snap-fitting structure is configured to allow the first and second floor panels to be positioned at a first position and a second position, wherein at the first position the first floor panel is angled to the second floor panel, and at the second position the first floor panel is substantially parallel to said second floor panel;

wherein said first floor panel is rotated about a contact portion of the lower step of the first floor panel and the upper groove of the second floor panel as an axle so that said first and second floor panel transitions from the first position to the second position.

* * * * *

UNITED STATES PATENT AND TRADEMARK OFFICE

CERTIFICATE OF CORRECTION

PATENT NO. : 8,281,549 B2
APPLICATION NO. : 12/297028
DATED : October 9, 2012
INVENTOR(S) : Yongsheng Du It is certified that error appears in the above-identified patent and that said Letters Patent is hereby corrected as shown below:

Title Page:

Item 73 in the Assignee Section:
Please delete "Shenzen (CN)" and insert --Shenzhen (CN)--

In the Claims:

Column 18, Claim 27, Line 12:
Please delete "claim 26" and insert --claim 10--

Column 18, Claim 29, Line 19:
Please delete "claim 26" and insert --claim 10--

Column 18, Claim 30, Line 22:
Please delete "claim 26" and insert --claim 10--

Column 18, Claim 32, Line 29:
Please delete "claim 26" and insert --claim 10--

Signed and Sealed this
Twenty-second Day of October, 2013

Teresa Stanek Rea
*Deputy Director of the United States Patent and Trademark Office*